US012728323B2

(12) United States Patent
Galvan et al.

(10) Patent No.: US 12,728,323 B2
(45) Date of Patent: Sep. 8, 2026

(54) GOLF CLUB HEAD WITH IMPROVED STRIKING FACE

(71) Applicant: Acushnet Company, Fairhaven, MA (US)

(72) Inventors: Darryl C. Galvan, El Cajon, CA (US); David S. Cornelius, San Marcos, CA (US); Christopher D. Harvell, San Marcos, CA (US); Kyle A. Carr, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 558 days.

(21) Appl. No.: 18/456,406

(22) Filed: Aug. 25, 2023

(65) Prior Publication Data

US 2023/0405413 A1 Dec. 21, 2023

Related U.S. Application Data

(63) Continuation-in-part of application No. 17/471,040, filed on Sep. 9, 2021, now Pat. No. 12,582,880.

(51) Int. Cl.
*A63B 53/04* (2015.01)

(52) U.S. Cl.
CPC ..... *A63B 53/0408* (2020.08); *A63B 53/0416* (2020.08); *A63B 53/0475* (2013.01)

(58) Field of Classification Search
CPC ..... A63B 53/0408; A63B 53/0416; A63B 53/042; A63B 53/0454; A63B 53/0458
See application file for complete search history.

(56) References Cited

U.S. PATENT DOCUMENTS

| | | | |
|---|---|---|---|
| 4,432,549 | A | 2/1984 | Zebelean |
| 6,508,722 | B1 | 1/2003 | McCabe et al. |
| 6,595,057 | B2 | 7/2003 | Bissonnette et al. |
| 6,679,786 | B2 | 1/2004 | McCabe |
| 6,800,038 | B2 | 10/2004 | Willett et al. |
| 6,824,475 | B2 | 11/2004 | Burnett et al. |
| 6,863,626 | B2 | 3/2005 | Evans et al. |
| 7,018,303 | B2 | 3/2006 | Yamamoto |
| 7,066,832 | B2 | 6/2006 | Willett et al. |
| 7,285,060 | B2 | 10/2007 | Williams |
| 7,347,794 | B2 | 3/2008 | Schweigert |
| 8,277,334 | B2 | 10/2012 | Meyer et al. |
| 8,439,769 | B2 | 5/2013 | Rice et al. |

(Continued)

FOREIGN PATENT DOCUMENTS

| | | | |
|---|---|---|---|
| JP | 2001087430 | A | 4/2001 |
| JP | 2002239040 | A | 8/2002 |

(Continued)

*Primary Examiner* — William M Pierce
(74) *Attorney, Agent, or Firm* — Mike S. Kim

(57) ABSTRACT

A golf club head with improved striking face is disclosed. More specifically, the present invention relates to a golf club head wherein the striking face is further comprised out of a thickened central region, located near a geometric center of the striking face portion, a central transition region extending outward radially from the thickened central region, a thinned intermediate region, extending outward radially from the central transition region, a thickened stress reducing region, extending outward radially from the thinned intermediate region, and a thinned perimeter region, extending outward radially from the thickened stress reducing region, all of which combine to form the improved striking face.

20 Claims, 18 Drawing Sheets

(56) References Cited

U.S. PATENT DOCUMENTS

| | | | |
|---|---|---|---|
| 8,801,541 | B2 | 8/2014 | Beach et al. |
| 8,956,246 | B2 | 2/2015 | Myrhum et al. |
| 9,623,292 | B2 | 4/2017 | Abe |
| 9,675,849 | B2 | 6/2017 | Beach et al. |
| 10,004,955 | B2 | 6/2018 | Henrikson et al. |
| 10,258,843 | B2 | 4/2019 | Morales et al. |
| 10,500,449 | B2 | 12/2019 | Henrikson et al. |
| 10,751,587 | B2 | 8/2020 | Clarke et al. |
| 10,758,789 | B2 | 9/2020 | Bacon et al. |
| 10,773,135 | B1 | 9/2020 | Hoffman et al. |
| 10,905,925 | B2 | 2/2021 | Morales et al. |
| 10,905,926 | B2 | 2/2021 | Morales et al. |
| 10,918,919 | B2 | 2/2021 | Morales et al. |
| 2004/0082404 | A1 | 4/2004 | Willett et al. |
| 2006/0063606 | A1 | 3/2006 | Schweigert et al. |
| 2014/0213387 | A1 | 7/2014 | Samson et al. |
| 2014/0323237 | A1 | 10/2014 | Beno et al. |
| 2016/0023062 | A1 | 1/2016 | Willett et al. |
| 2016/0023063 | A1 | 1/2016 | Willett et al. |
| 2019/0192927 | A1 | 6/2019 | Bacon et al. |
| 2019/0224540 | A1 | 7/2019 | Morales et al. |
| 2019/0262675 | A1 | 8/2019 | Clarke et al. |
| 2020/0346081 | A1 | 11/2020 | Bacon et al. |
| 2021/0113896 | A1 | 4/2021 | Greensmith et al. |
| 2022/0016500 | A1 | 1/2022 | Greer et al. |

FOREIGN PATENT DOCUMENTS

| | | | |
|---|---|---|---|
| JP | 2014113367 | A | 6/2014 |
| JP | 2020-518372 | A | 6/2020 |

GOLF CLUB HEAD WITH IMPROVED STRIKING FACE

RELATED APPLICATIONS

The present application is a continuation-in-part of U.S. application Ser. No. 17/471,040, filed on Sep. 9, 2021, which is hereby incorporated by reference in its entirety.

FIELD OF THE INVENTION

The present invention relates generally to a golf club head with an improved striking face. More specifically, the present invention relates to a metalwood type golf club head, wherein the striking face is further comprised out of a thickened central region, located near a geometric center of the striking face portion, a central transition region extending outward radially from the thickened central region, a thinned intermediate region, extending outward radially from the central transition region, a thickened stress reducing region, extending outward radially from the thinned intermediate region, and a thinned perimeter region, extending outward radially from the thickened stress reducing region, all of which combine to form the improved striking face.

BACKGROUND OF THE INVENTION

The striking face of a golf club head is the singular component in a golf club head that experiences the highest level of stress when impacting a golf ball. Moreover, with the striking face being the only component that comes in contact with a golf ball, it is one of the key critical components to any golf club design.

In order to improve the performance of a golf club head via the striking face, golf club designers have tried to create an extremely thin striking face, allowing the striking face to elastically deform when impacting a golf ball, thus increasing the speed of a golf ball once it leaves the striking face of the golf club head; all while staying within the rules of golf. U.S. Pat. No. 4,432,549 to Zebelean illustrates one of the earlier attempts to thin out the striking face of a golf club head by thinning out the upper portion of the striking face of a golf club head Thinning out the face is not the only way to improve performance of the striking face of a golf club head, as more current improvements include the adjustment of the thickness of the various portions of the striking face to improve performance. Building upon the already thinned face, U.S. Pat. No. 6,863,626 to Evans et al. illustrates one of the earlier attempts to vary the thickness of the striking face of a golf club head by disclosing a thickened central region that decreases outward from the center, to help slow down the speed of a golf ball at the center to create a larger area of improved speed and performance.

Further building upon the known technology of a thinned face that's combined with a thickened central portion, to further improvements to the performance of the golf club head U.S. Pat. No. 10,758,789 to Bacon et al, adds a thickened perimeter region at the extremities of the striking face, which the inventors claim to improve durability, increase ball speed, and increase characteristic time. However, the addition of this, although beneficial, is not optimized because the benefit of a thickened perimeter region is generally localized and does not need to extend all the way to the perimeter of the striking face as shown by U.S. Pat. No. 10,758,789.

Hence it can be seen that further improvements can be made to golf club heads that have a thinned face, thickened central region, and have a thickened perimeter region by removing unnecessary weight from the extremities of the perimeter of the striking face, and only localizing the thickened perimeter region at optimized locations that could benefit from such feature.

BRIEF SUMMARY OF THE INVENTION

One aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise, a thickened central region, located near a geometric center of the striking face portion, having a first thickness; a central transition region, extending outward radially from the thickened central region, having a variable thickness; a thinned perimeter region, extending outward radially from the central transition region, having a third thickness; a thickened stress reducing region, extending outward radially from the thinned intermediate region, having a fourth thickness; and a thinned perimeter region, extending outward radially from thickened stress reducing region, having a fifth thickness, wherein the thickened stress reducing region forms a ring protruding rearward from the internal rear surface of the striking face portion, and wherein the fourth thickness is greater than the first thickness.

In another aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise, a thickened central region, located near a geometric center of the striking face portion, having a first thickness; a central transition region, extending outward radially from the thickened central region, having a variable thickness; a thinned perimeter region, extending outward radially from the central transition region, having a third thickness; a thickened stress reducing region, extending outward radially from the thinned intermediate region, having a fourth thickness; and a thinned perimeter region, extending outward radially from thickened stress reducing region, having a fifth thickness, wherein the thickened stress reducing region forms a ring protruding rearward from the internal rear surface of the striking face portion, wherein the fifth thickness is less than the fourth thickness, and wherein the third thickness of the thinned intermediate region is the thinnest portion of the striking face portion.

In another aspect of the present invention is a golf club head comprising of a striking face portion, located at a frontal portion of the golf club head, adapted to impact a golf ball, and a body portion attached to a rear of the striking face portion. The striking face portion further comprises a frontal striking surface, wherein the frontal striking surface is substantially planar, and an internal rear surface, wherein the frontal striking surface and the internal rear surface combine to further comprise a thickened stress reducing region, located proximate a perimeter of said striking face portion, wherein the thickened stress reducing region forms a ring protruding rearward from the internal rear surface of the striking face portion, and wherein the thickened stress reducing region is placed at a distance of between about 15 mm to about 30 mm from a geometric center of the striking face portion, measured across a vertical cross-section passing through the geometric center of the striking face portion.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
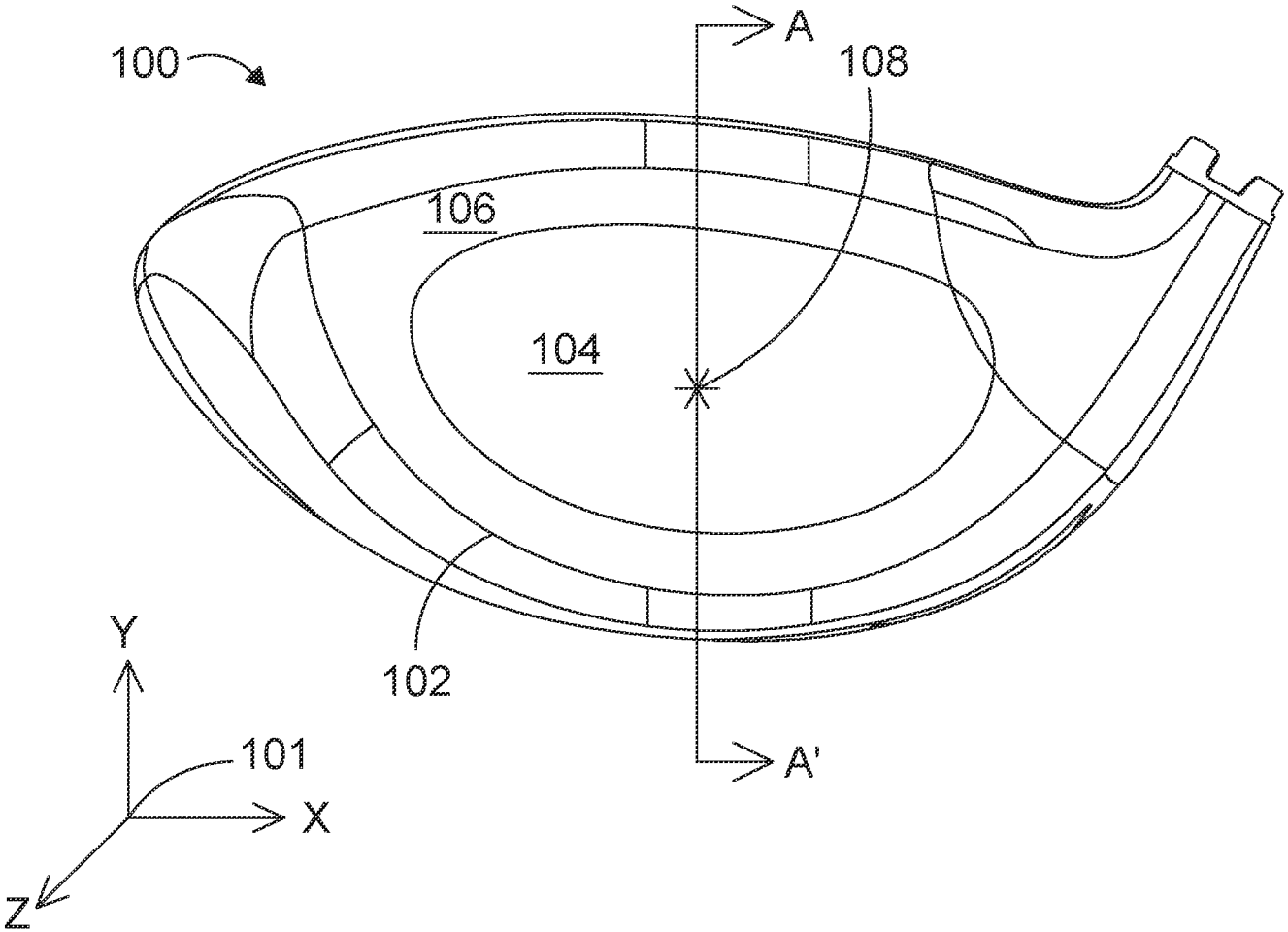
FIG. 1 of the accompanying drawings shows a frontal view of a golf club head in accordance with an exemplary embodiment of the present invention, allowing cross-sectional line A-A' to be shown.

FIG. 1 of the accompanying drawings shows a frontal view of a golf club head 100 in accordance with an exemplary embodiment of the present invention. First and foremost, FIG. 1 of the accompanying drawings shows a coordinate system 101, which defines the orientation of the golf club head 100 along the x, y, and z axes. The x-axis shown here is horizontal and spans in a heel to toe direction, with the positive axis pointing to the heel of the golf club head 100. The y-axis shown here is vertical and spans in a crown to sole direction, with the positive axis pointing to the crown of the golf club head 100. Finally, the z-axis shown here refers to the axis that points in and out of the page, and spans in a forward and back direction, with the positive axis pointing towards the front of the golf club head 100. This frontal view of the golf club head 100 shows the striking face portion 102, which in this embodiment is further comprised out of a face insert 104 and a face perimeter 106. FIG. 1 of the accompanying drawings also shows a cross-sectional line A-A' vertically along the y axis, along the y-z plane, allowing the internal geometry of the striking face portion 102 to be shown more clearly.

Figure 2:
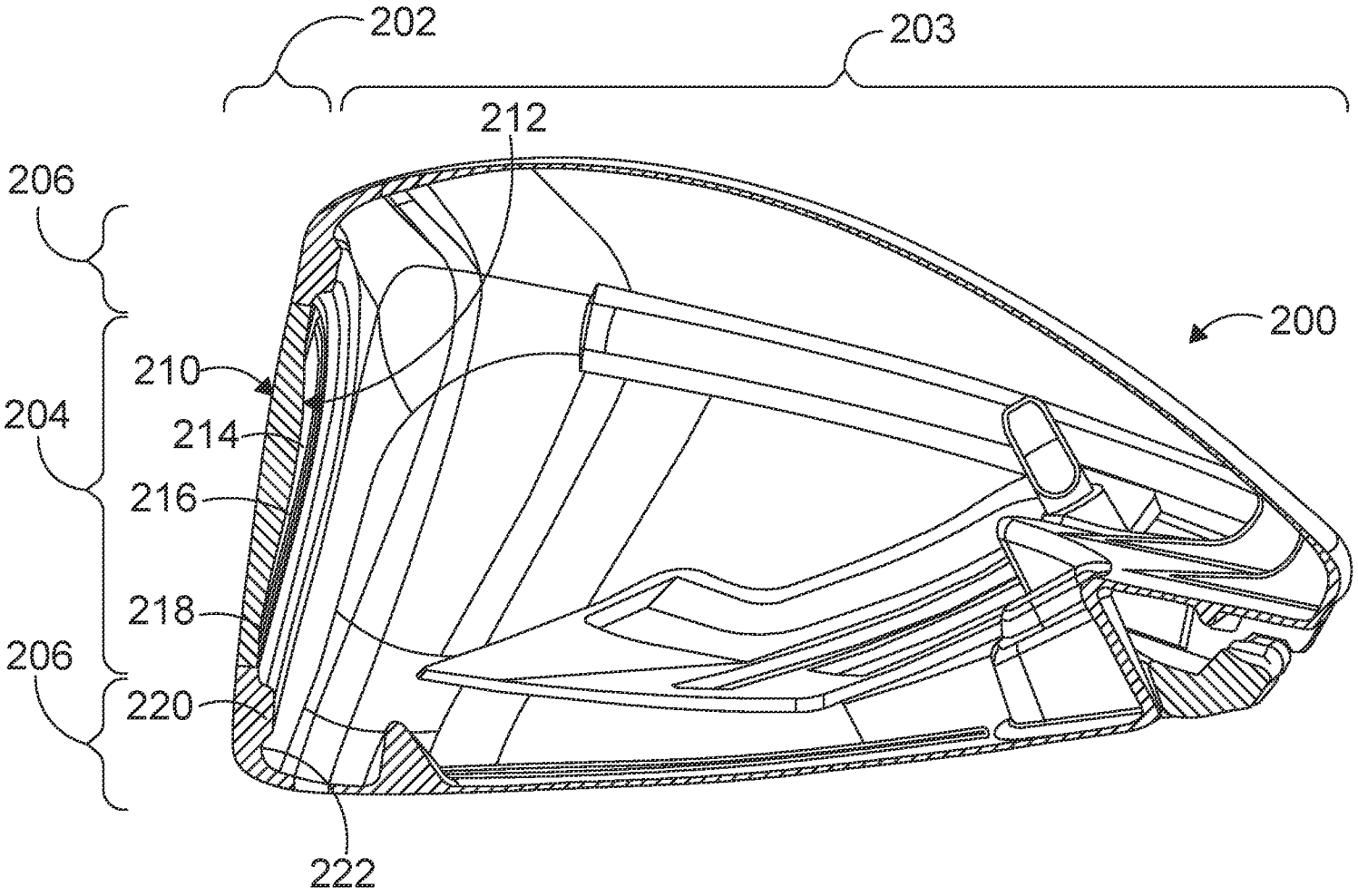
FIG. 2 of the accompanying drawings shows a cross-sectional view of a golf club head in accordance with an exemplary embodiment of the present invention, taken along cross-sectional line A-A' shown in FIG. 1.

FIG. 2 of the accompanying drawings shows a cross-sectional view of a golf club head 200, taken along cross-sectional line A-A' shown in FIG. 1. In this cross-sectional view of the golf club head 200 shown in FIG. 2, we can see that the golf club head 200 is has a striking face portion 202 and a rear body portion 203, attached to the rear of the striking face portion 202. The striking face portion 202, as defined in the present invention, refers to the portion of the golf club head 200 that is substantially planar, and located at the frontal portion of the golf club head 200, adapted to strike a golf ball. The striking face portion 202 is formed by the thickness created by a substantially planar frontal striking surface 210 and a rear internal surface 212 having a variable contour, thus creating a striking face portion with a variable face thickness profile. The demarcation between the striking face portion 202 and the rear body portion 203 occurs when the rear internal surface 212 deviates from a substantially planar vertical orientation towards a substantially horizontal orientation.

Finally, FIG. 2 of the accompanying drawings shows that in this embodiment, a face insert 204 is used and it closes an opening in the striking face portion 202 created by the face perimeter 206. In this embodiment of the present invention, the face insert 204 may generally be made from a titanium material for its light weight and high durability characteristics; and may generally be significantly thinner than traditional golf club heads having a similar construction due to the unique thickened stress reducing region 216 around the face perimeter 206. In this embodiment of the present invention, the thickened stress reducing region 220 around the face perimeter 206 allows for the face insert 204 to be thinner and lighter, yielding a mass of less than about 25 grams, more preferably less than about 24 grams, and most preferably less than about 23 grams, all without departing from the scope and content of the present invention. Compared to a face insert installed without the thickened stress reducing region 220 around the face perimeter 206, the mass of the face insert is decreased by approximately 12 grams.

Figure 3:
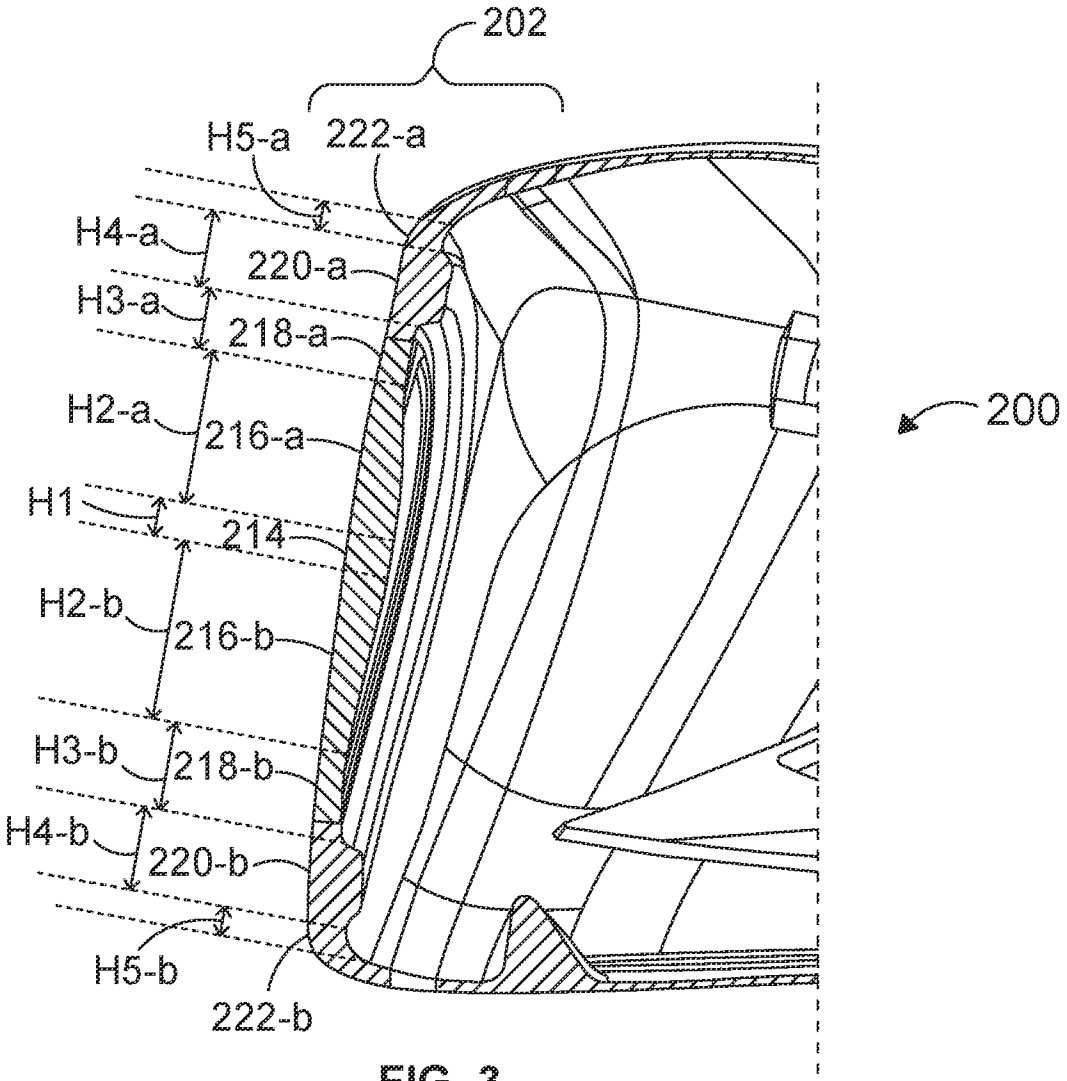
FIG. 3 of the accompanying drawings shows an enlarged cross-sectional view of a striking face portion of a golf club head in accordance with an exemplary embodiment of the present invention shown in FIG. 2.

In order to illustrate more detail regarding the thickened stress reducing region 220 around the face perimeter 206 together with the remainder of the striking face portion 202 geometry such as the thickened central region 214, the central transition region 216, the thinned intermediate region 216, and the thinned perimeter region 222, an enlarged view of the striking face portion 202 is provided in FIG. 3.

FIG. 3 of the accompanying drawings shows an enlarged cross-sectional view of the striking face portion 202 of a golf club head 200. This enlarged cross-sectional view allows the various heights of the striking face portion 202 to be shown more clearly, while FIG. 4 of the accompanying drawings will illustrate the various thicknesses of the striking face portion 202. In accordance with this shown exemplary embodiment of the present invention, the striking face portion 202 is further comprised of a thinned upper perimeter region **222-*a* and a thinned lower perimeter region 222-*b*, combining to form a thinned perimeter region 222. Located inward from the thinned perimeter region, the striking face portion 202 has an upper thickened stress reducing region 220-*a* and a lower thickened stress reducing region 220-*b* combining to form a thickened stress reducing region 220. Alternatively speaking, it can be said that the thickened stress reducing region 220 forms a ring that protrudes rearward from the internal surface 212 of the striking face portion 202. Located inward from the thickened stress reducing region, the striking face portion 202 has an upper thinned intermediate region 218-*a* and a lower thinned intermediate region 218-*b*, combining to form a thinned intermediate region 218. Located inward from the thinned intermediate region, the striking face portion 202 has an upper central transition region 216-*a* and a lower central transition region 216-*b*, combining to form the central transition region 216. Finally, the striking face portion 202 has a thickened central region 214 located inward of the central transition region 214**.

In this embodiment of the present invention shown in FIG. 3, the height H1 of the thickened central region 214 may generally be between about 4.0 mm and about 15.0 mm, more preferably between about 4.0 mm and about 10.0 mm, and most preferably about 4.0 mm.

The height of the central transition region 216, in accordance with this embodiment of the present invention, may also be greater below the thickened central region 214 than above the thickened central region 214. Hence, in accordance with this embodiment, the height H**2-*a* of the upper central transition region 216-*a* is between about 7.0 mm and about 11.0 mm, more preferably between about 8.0 mm and about 10.0 mm, and most preferably about 9.0 mm. The height H2-*b* of the lower central transition region 216-*b* may generally be between about 13.0 mm to about 17.0 mm, more preferably between about 14.0 mm to about 16.0 mm, and most preferably about 15.0 mm. However, it should be noted that in alternative embodiments, the height of the upper central transition region 216**-*a* and the lower central transition region 216-*b* may be the same without departing from the scope and content of the present invention.

The height of the thinned intermediate region 218, in accordance with this embodiment of the present invention, may also be greater below the thickened central region 214 than above the thickened central region 214. Hence, in accordance with this embodiment, the height H3-*a* is generally between about 3.5 mm and about 5.5 mm, more preferably between about 4.0 mm and about 5.0 mm, and most preferably about 4.5 mm. The height H3-*b* of the lower central transition region 218-*b* may generally be between about 6.5 mm to about 8.5 mm, more preferably between about 7.0 mm to about 8.0 mm, and most preferably about 7.5 mm. However, it should be noted that in alternative embodiments, the height of the upper central transition region 218-*a* and the lower central transition region 218-*b* may be the same without departing from the scope and content of the present invention.

The height of the thickened stress reducing region 220, different from previous measurements, is the same measurement irrespective of whether the measurement is for the upper thickened stress reducing region 220-*a* or the lower thickened stress reducing region 220-*b*. Hence, in accordance with this embodiment, the height H4-*a* and H4-*b* are both between about 4.0 mm and about 6.0 mm, more preferably between about 4.5 mm and about 5.5 mm, and most preferably about 5.0 mm. Similar to the logic above, having different H4-*a* and H4-*b* values also does not deviate from the scope and content of the present invention, so long as both fall within the ranges articulated above. It is worth noting here that the height of the thickened stress reducing region 220 is critical to the proper functionality of the present invention, as it carefully balances the need to not add too much unnecessary mas to the striking face portion 202, but also the need to provide enough structural rigidity to reduce the stress from the face perimeter 106 (shown in FIG. 1) to allow the remainder of the striking face portion 202 to be made thinner and more efficient. The height of the thickened stress reducing region 220, combined with the thickness of the thickened stress reducing region 220 (to be discussed later in FIG. 4), will outline the optimized geometry to achieve the performance gains of the present invention.

Before moving on to a discussion regarding the thinned perimeter region 222, it is important to note that the placement of the thickened stress reducing region 220 relative to the geometric face center 108 (shown in FIG. 1) is critical to the achieve the proper performance gains in the present invention. This is especially true along the vertical cross-sectional plane passing through the geometric face center 108 (shown in FIG. 1) as shown here in the enlarged cross-sectional view shown in FIG. 3. The criticality of this specific cross-section, and the placement of the thickened stress reducing region 220 along this cross-section, derives from the tendency of the striking face portion 202 to exhibit higher stress risers in the upper face portion along this plane; hence the addition of the thickened stress reducing region 220. In this embodiment of the present invention, the thickened stress reducing region 220 may generally be placed at a distance of between about 15 mm to about 30 mm away from the geometric face center 105, along the cross-sectional plane A-A', more preferably placed at a distance of between about 17 mm to about 28 mm away from the geometric face center 105 (shown in FIG. 1), along the cross-sectional plane A-A', and most preferably between about 20 mm to about 25 mm away from the geometric face center 105 (shown in FIG. 1), along the cross-sectional plane A-A'.

The height of the thinned perimeter region 222, may also be greater below the thickened central region 214 than above the thickened central region 214. Hence, in accordance with this embodiment, the height H5-*a* is between about 1.8 mm and about 2.8 mm, more preferably between about 2.1 mm and about 2.5 mm, and most preferably about 2.3 mm. The height H5-*b* may generally be between about 2.3 mm to about 3.3 mm, more preferably between about 2.6 mm to about 3.0 mm, and most preferably about 2.8 mm. However, it should be noted that in alternative embodiments, the height of the upper thinned perimeter region 222-*a* and the lower thinned perimeter region 222-*b* may be the same without departing from the scope and content of the present invention.

Figure 4:
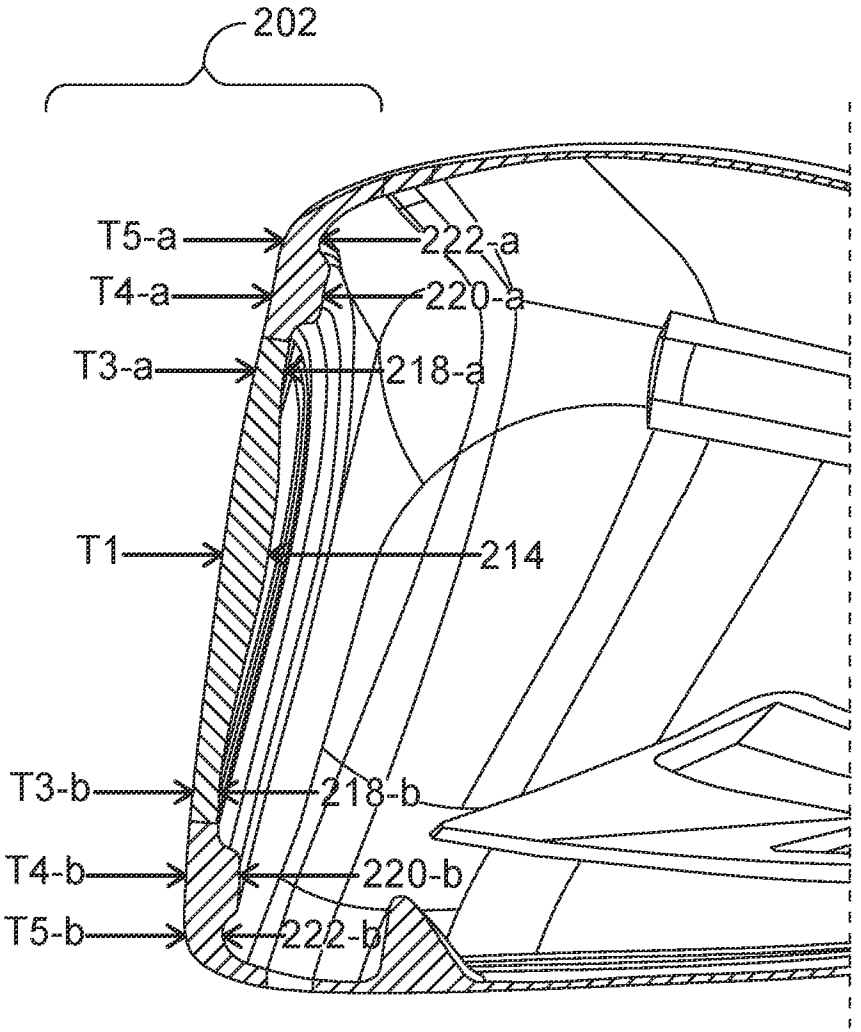
FIG. 4 of the accompanying drawings, again, shows an enlarged cross-sectional view of a striking face portion of a golf club head in accordance with an exemplary embodiment of the present invention shown in FIG. 2, allowing different features to be highlighted.

FIG. 4 of the accompanying drawings shows another enlarged cross-sectional view of the striking face portion 202 of a golf club head 200. In this cross-sectional view, the various thicknesses of the components of the striking face portion 202 is shown in more detail. In this current embodiment of the present invention, the thickened central region 214 may generally have a thickness T1 of less than about 3.6 mm, more preferably less than about 3.4 mm, and most preferably less than about 3.2 mm; as the goal of the present invention is to minimize the thickness of various components of striking face portion 202, via the introduction of the thickened stress reducing region 220 that alleviate stress on the striking face portion 202.

The thickness of the thinned intermediate region 218 may generally be the same irrespective of whether it's located at the upper thinned intermediate region 218-*a* or the lower thinned intermediate region 218-*b*. Hence, the thickness T3-*a* and T3-*b* are both less than about 2.5 mm, more preferably less than about 2.4 mm, and most preferably less than about 2.3 mm. However, in alternative embodiments of the present invention, T3-*a* and T3-*b* values may be slightly different from one another and will not deviate from the scope and content of the present invention, so long as both fall within the ranges articulated above.

The thicknesses of the thickened stress reducing region 220, shown here as an upper thickened stress reducing region 220-*a* having a thickness T4-*a* and lower thickened stress reducing region 220-*b* having a thickness T4-*b*, combines with the width of the thickened stress reducing region 220 define a geometry that is critical to the improved performance of the striking face portion 202 of the golf club head. In this embodiment, the thicknesses T4-*a* and T4-*b*, for the upper thickened stress reducing region 220-*a* and lower thickened stress reducing region 220-*b* respectively, are both the same, hence yielding a thickness of between about 3.6 mm to about 4.4 mm, more preferably between about 3.8 mm top about 4.2 mm, and most preferably about 4.0 mm. However, in alternative embodiments of the present invention, the thicknesses T4-*a* and T4-*b* could deviate slightly from one another without departing from the scope and content of the present invention, so long as it does not fall outside the scope of the thickness ranges defined above.

Once the thickness T4 and the height H4 of the thickened stress reducing region 220 have been defined, a preferred geometric shape of the thickened stress reducing region 220 can be established as a ratio of the thickness and the height. The preferred geometric shape will have a T over H Ratio defined by Equation (1) below:

$$T \text{ over } H \text{ Ratio} = \frac{\text{Thickness } T4 \text{ of Thickened Stress Reducing Region}}{\text{Height } H4 \text{ of Thickened Stress Reducing Region}} \quad \text{Eq. (1)}$$

The T over H Ratio of the thickened stress reducing region 220 of the striking face portion 202 in accordance with the present invention may generally be between about 0.6 to about 1.1, more preferably between about 0.7 to about 0.9, and most preferably about 0.8. Once again, as previously mentioned, this ratio is critical to achieving the stress reducing properties of the striking face portion 202, all while minimizing the unnecessary mass added by the addition of this thickened stress reducing region 220.

The thickness of the thinned perimeter region 222 may generally be the same irrespective of whether it's located at the upper thinned perimeter region 22-*a* or the lower thinned perimeter region 222-*b*. Hence, the thickness T5-*a* and T5-*b* are both less than about 3.0 mm, more preferably less than about 2.8 mm, and most preferably less than about 2.7 mm. However, in alternative embodiments of the present invention, T5-*a* and T5-*b* values may be slightly different from one another and will not deviate from the scope and content of the present invention, so long as both fall within the ranges articulated above.

Another important relationship worth highlighting here is the thickness T4 of the thickened stress reducing region 720 versus the thickness T1 of the thickened central region 714. Because the introduction of the thickened stress reducing region 720 greatly decreases the overall thickness and mass of the entire striking face portion 702, the resultant relationship between the two thicknesses is critically important to achieving the improved performance of the present invention. In this exemplary embodiment of the present invention, the ratio of T4 divided by T1 is generally greater than about 1, more preferably greater than about 1.15, and most preferably greater than about 1.375. Alternatively speaking, it can be said that the thickness T4 of the thickened stress reducing region 220 is greater than a thickness T1 of the thickened central region 214, or any other location along the entirety of the striking face portion 202. The thickest portion of the striking face portion 202 is located on the thickened stress reducing region 220.

Figure 5:
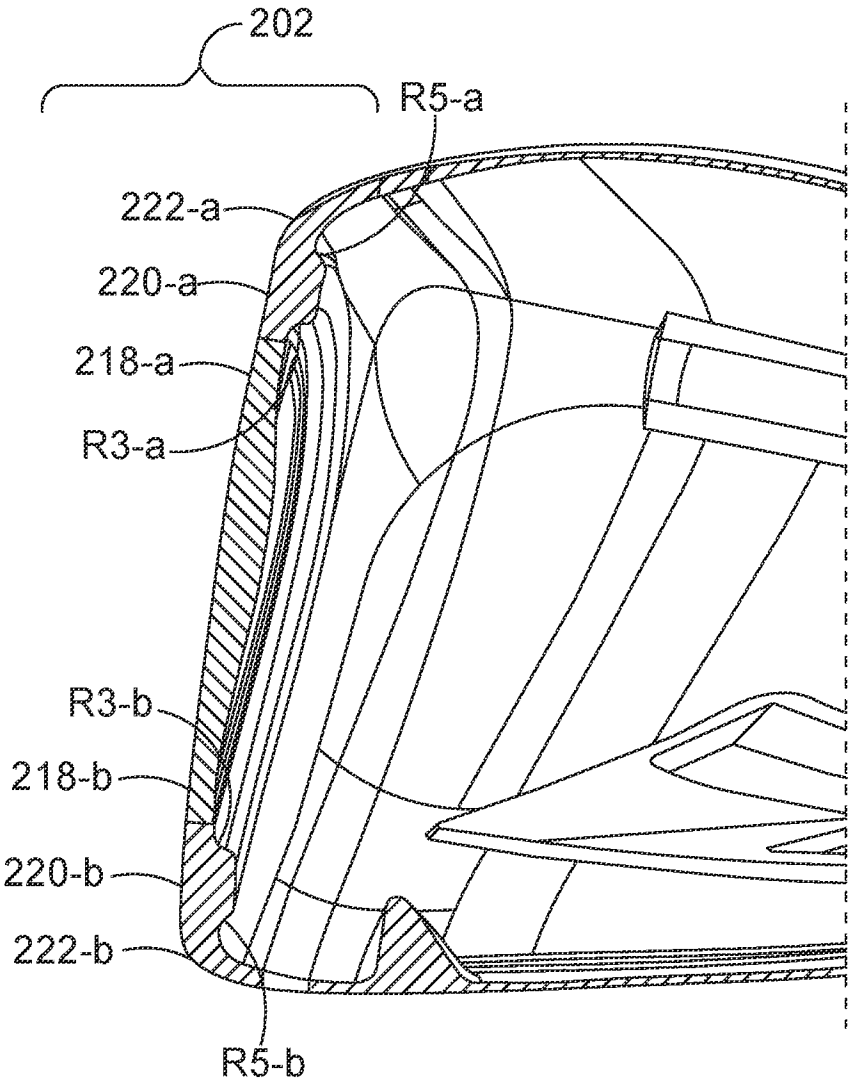
FIG. 5 of the accompanying drawings, once again, shows an enlarged cross-sectional view of a striking face portion of a golf club head in accordance with an exemplary embodiment of the present invention shown in FIG. 2, allowing different features to be highlighted.

FIG. 5 of the accompanying drawings shows that same enlarged cross-sectional view of the striking face portion 202 of a golf club head 200 as FIGS. 3 and 4, but this time focusing on the transition of the thickened stress reducing region 220 to its neighboring thinned intermediate region 218 and thinned perimeter region 222. In this embodiment of the present invention, the various radii around the thickened stress reducing region 220 is also critical to the proper functionality of the present invention, as undesirable radii not only does not serve the purpose of reducing stress but could also add to the manufacturing challenges. On top of everything, the radii also needs to be a balance of, on one hand, minimizing the undesirable weight additions attributed to the addition of the thickened stress reducing region 220, and on the other hand the stress and manufacturing challenges attributed to the thickened stress reducing region 220.

Radius R5-*a* and Radius R5-*b* indicate the radius of curvature or the blend from the thickened stress reducing region 220-*a* and 220-*b* towards the thinned perimeter region 222-*a* and 222-*b*. R5-*a* and R5-*b* in this embodiment may generally be the same number and is generally between about 1.0 mm and about 1.4 mm, more preferably between about 1.1 mm and about 1.3 mm, and most preferably about 1.2 mm. However, it should be noted that in alternative embodiments of the present invention R5-*a* and R5-*b* may be different from one another without departing from the scope and content of the present invention so long as it falls within the radius ranges articulated above.

Radius R3-*a* and Radius R3-*b* indicate the radius of curvature or the blend from the thickened stress reducing region 220-*a* and 220-*b* towards the thinned intermediate region 218-*a* and 218-*b*. R3-*a* and R3-*b* in this embodiment may generally be the same number and also the same as the R5-*a* and R5-*b* above between about 1.0 mm and about 1.4 mm, more preferably between about 1.1 mm and about 1.3 mm, and most preferably about 1.2 mm. However, it should be noted that in alternative embodiments of the present invention R3-*a* and R3-*b* may be different from one another without departing from the scope and content of the present invention so long as it falls within the radius ranges articulated above.

It is worth noting here that the radius of the blend from the thickened stress reducing region 220 towards the thinned perimeter region 222 and the thinned intermediate region 218, shown as R5 and R3 respectively, may generally be the same as one another. However, as previously mentioned, in alternative embodiments of the present invention, these numbers could differ from one another without departing from the scope and content of the present invention so long as they fall within the ranges above.

Figure 6A:
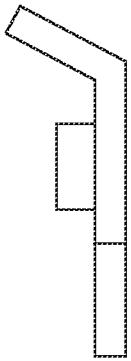
FIG. 6*a* of the accompanying drawing shows a representative cross-sectional view of a thickened stress reducing region accordance with an exemplary embodiment of the present invention.
Figure 6B:
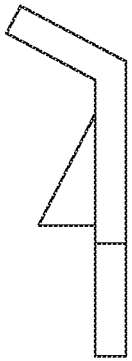
FIG. 6*b* of the accompanying drawings shows a representative cross-sectional view of a thickened stress reducing region in accordance with an alternative embodiment of the present invention.
Figure 6C:
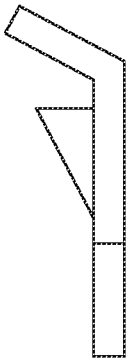
FIG. 6*c* of the accompanying drawings shows a representative cross-sectional view of a thickened stress reducing region in accordance with an even further alternative embodiment of the present invention.
Figure 6D:
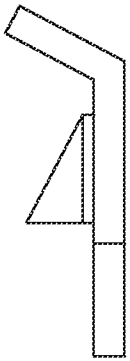
FIG. 6*d* of the accompanying drawings shows a representative cross-sectional view of a thickened stress reducing region in accordance with an even further alternative embodiment of the present invention.
Figure 6E:
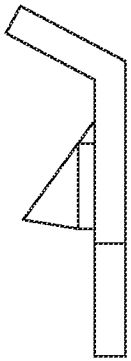
FIG. 6*e* of the accompanying drawings shows a representative cross-sectional view of a thickened stress reducing region in accordance with an even further alternative embodiment of the present invention.
Figure 6F:
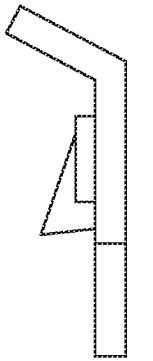
FIG. 6*f* of the accompanying drawings shows a representative cross-sectional view of a thickened stress reducing region in accordance with an even further alternative embodiment of the present invention.
Figure 6G:
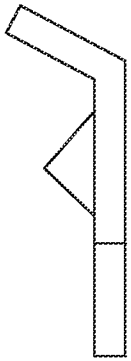
FIG. 6*g* of the accompanying drawings shows a representative cross-sectional view of a thickened stress reducing region in accordance with an even further alternative embodiment of the present invention.
Figure 6H:
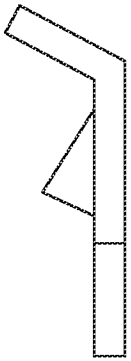
FIG. 6*h* of the accompanying drawings shows a representative cross-sectional view of a thickened stress reducing region in accordance with an even further alternative embodiment of the present invention.
Figure 6I:
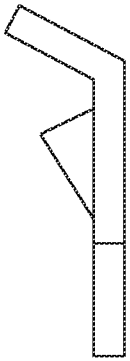
FIG. 6*i* of the accompanying drawings shows a representative cross-sectional view of a thickened stress reducing region in accordance with an even further alternative embodiment of the present invention.
Figure 6J:
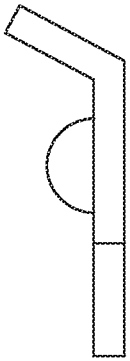
FIG. 6*j* of the accompanying drawings shows a representative cross-sectional view of a thickened stress reducing region in accordance with an even further alternative embodiment of the present invention.
Figure 6K:
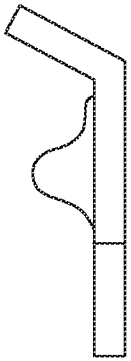
FIG. 6*k* of the accompanying drawings shows a representative cross-sectional view of a thickened stress reducing region in accordance with an even further alternative embodiment of the present invention.
Figure 6L:
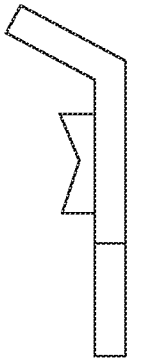
FIG. 6L of the accompanying drawings shows a representative cross-sectional view of a thickened stress reducing region in accordance with an even further alternative embodiment of the present invention.

FIGS. 6*a* through 6L of the accompanying drawings shows alternate geometries for the thickened stress reducing region 220. In FIG. 6*a*, a substantially rectangular design is shown here, like the design previously shown that added the transition radii. FIG. 6*b* of the accompanying drawings shows an alternate outward taper design of the thickened stress reducing region 220 in accordance with an alternative embodiment of the present invention. FIG. 6*c* of the accompanying drawings shows an alternate inward taper design of the thickened stress reducing region 220 in accordance with an alternative embodiment of the present invention. FIG. 6*d* of the accompanying drawings shows an alternate outward taper with constant offset design of the thickened stress reducing region 220 in accordance with an alternative embodiment of the present invention. FIG. 6*e* of the accompanying drawings shows an alternate outward taper with inner offset design of the thickened stress reducing region 220 in accordance with an alternative embodiment of the present invention. FIG. 6*f* of the accompanying drawings shows an alternate outward taper with outer offset design of the thickened stress reducing region 220 in accordance with an alternative embodiment of the present invention. FIG. 6*g* of the accompanying drawings shows an alternate triangular chevron design of the thickened stress reducing region 220 in accordance with an alternative embodiment of the present invention. FIG. 6*h* of the accompanying drawings shows an alternate inward offset triangular chevron design of the thickened stress reducing region 220 in accordance with an alternative embodiment of the present invention. FIG. 6*i* of the accompanying drawings shows an alternate outward offset triangular chevron design of the thickened stress reducing region 220 in accordance with an alternative embodiment of the present invention. FIG. 6*j* of the accompanying drawings shows an alternate hemisphere design of the thickened stress reducing region 220 in accordance with an alternative embodiment of the present invention. FIG. 6*k* of the accompanying drawings shows an alternate organic design of the thickened stress reducing region 220 in accordance with an alternative embodiment of the present invention. FIG. 6*b* of the accompanying drawings shows an alternate depression channel taper design of the thickened stress reducing region 220 in accordance with an alternative embodiment of the present invention.

Figure 7A:
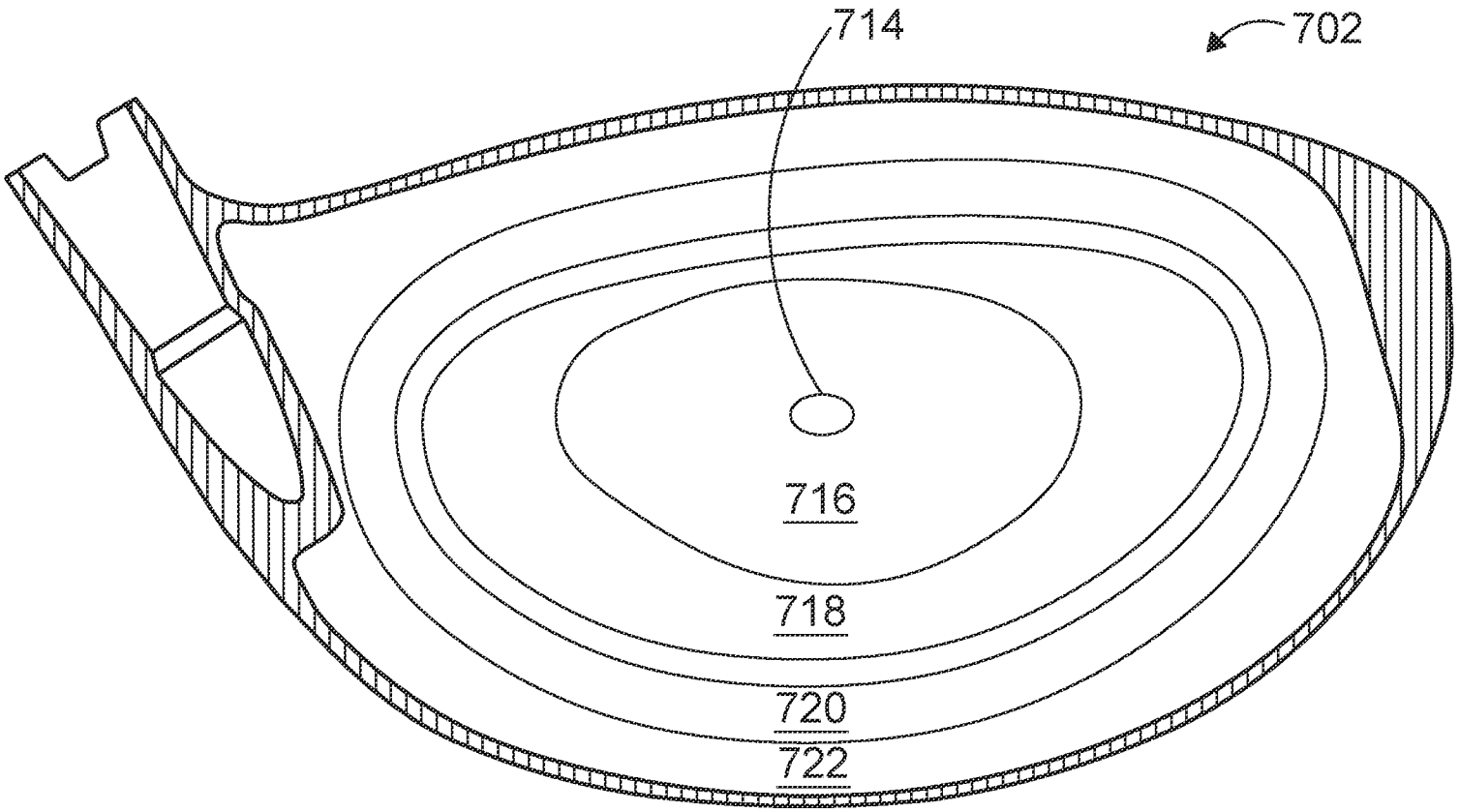
FIG. 7*a* of the accompanying drawings shows a rear shaded view of a striking face portion of a golf club head in accordance with an exemplary embodiment of the present invention.
Figure 7B:
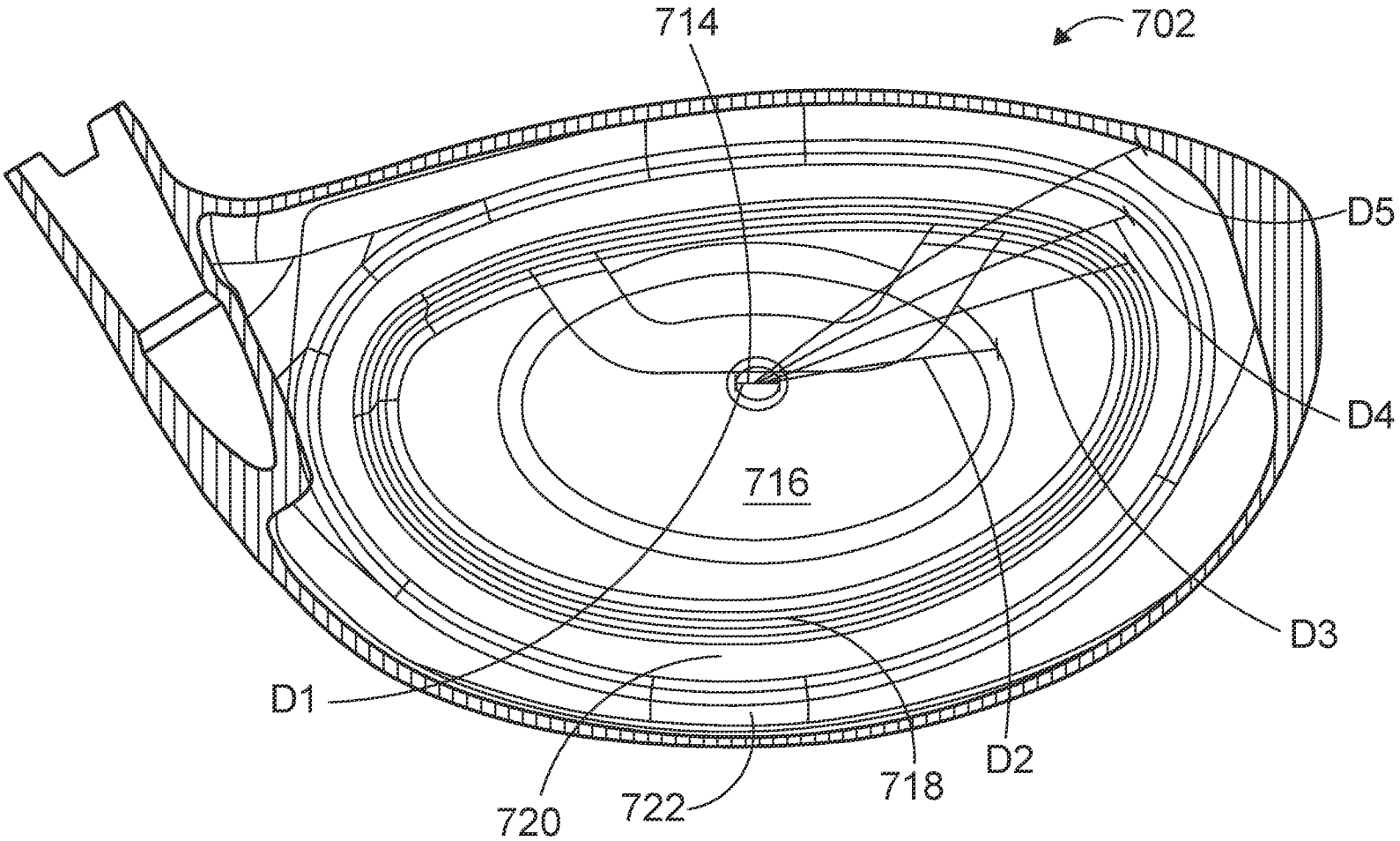
FIG. 7*b* of the accompanying drawings shows a rear view of a striking face portion of a golf club head in accordance with an exemplary embodiment of the present invention.

FIGS. 7*a* and 7*b* show a rear view of the striking face portion 702 of a golf club head in accordance with an exemplary embodiment of the present invention. In FIG. 7*a*, a shaded view is presented to provide a better visual of the various components of the striking face portion 702. In FIG. 7*a*, a thinned perimeter region 722 forms the outer perimeter of the striking face portion 702. Inward from the thinned perimeter region 722, we can see the thickened stress reducing region 720. Inward from the thickened stress reducing region 720 is the thinned intermediate region 718. Inward from the thinned intermediate region 718 is the central transition region 716. Finally, at the geometric center of the striking face portion 702 is the thickened central region 714. In addition to illustrating the various components of the striking face portion 701, FIG. 7*a* also illustrates how the height of the various components can vary depending on where it is located on the face, and the previous measurements of the various component heights were only referring to a cross-sectional plane along the geometric center of the face as shown in FIG. 1. In one example, once can see that the height of the intermediate transition region 718 is generally smaller at the crown and sole portion of the striking face portion 702 when compared to the height of the intermediate transition region 718 at the heel and toe portion of the striking face portion 702.

To better illustrate the differences of the height of the various components along different portions of the face, a non-shaded rear view of the striking face portion 702 is provided in FIG. 7*b*. In addition to the above, FIG. 7*b* allows the radial distances of the various components to be shown in more detail, as all measurements are taken from the geometric center 108 (shown in FIG. 1) of the face; like the previous discussion regarding the location of the thickened stress reducing region 220 in FIG. 2. However, the distances provided here are not constrained in any specific cross-sectional plane A-A' like the previous discussion in FIG. 2, but rather a measurement of the minimum and maximum distances in any radial direction. In this rear view of the striking face portion 702 shown in FIG. 7*b*, we can see that the outer perimeter of the thickened central region 714 is generally located within a projected distance D1 of between about 4.00 mm and about 14.0 mm from a geometric face center across any radial direction. The outer perimeter of the central transition region 716 may generally be located at a distance D2 of between about 13.0 mm and about 30.0 mm from the geometric face center across any radial direction. The outer perimeter of the thinned intermediate region 718 may generally be located at a distance D3 of between about 17.0 mm and about 40.0 mm from the face center across any radial direction. The outer perimeter of the thickened stress reducing region 720 may generally be located at a distance D4 of between about 15.0 mm and about 46.0 mm from the face center across any radial direction. Finally, the outer perimeter of the thinned perimeter region 722 may generally be located at a distance D5 of between about 25.50 mm and about 55.5 mm from the face center across any radial direction.

Figure 8:
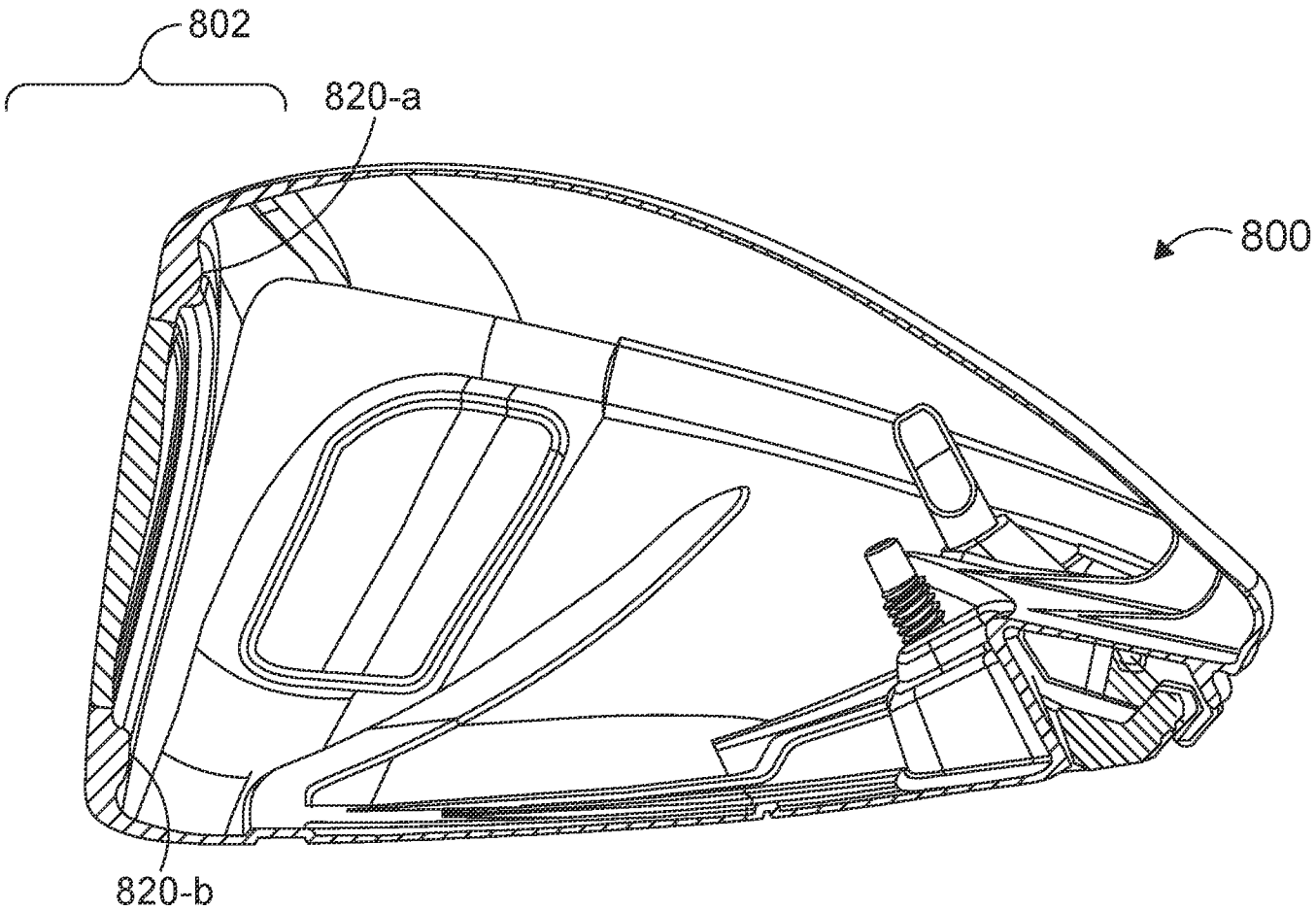
FIG. 8 of the accompanying drawings shows a cross-sectional view of a golf club head in accordance with a further alternative embodiment of the present invention, taken along cross-sectional line A-A' shown in FIG. 1.

FIG. 8 of the accompanying drawings shows a cross-sectional view of a golf club head 800, in accordance with an alternative embodiment of the present invention, taken along cross-sectional line A-A' shown in FIG. 1. In this cross-sectional view of the present invention, the shape and geometry of upper thickened stress reducing region 820-*a* is changed to be different from the lower thickened stress reducing region 820-*b* to help address high stress levels that generally occur in the upper crown region of the striking face portion 802. In order to illustrate this difference in height and radius of curvature of the blend between the upper thickened stress reducing region 820-*a* and the lower thickened stress reducing region 820-*b*, an enlarged view of the striking face portion 802 is provided in FIG. 9.

Figure 9:
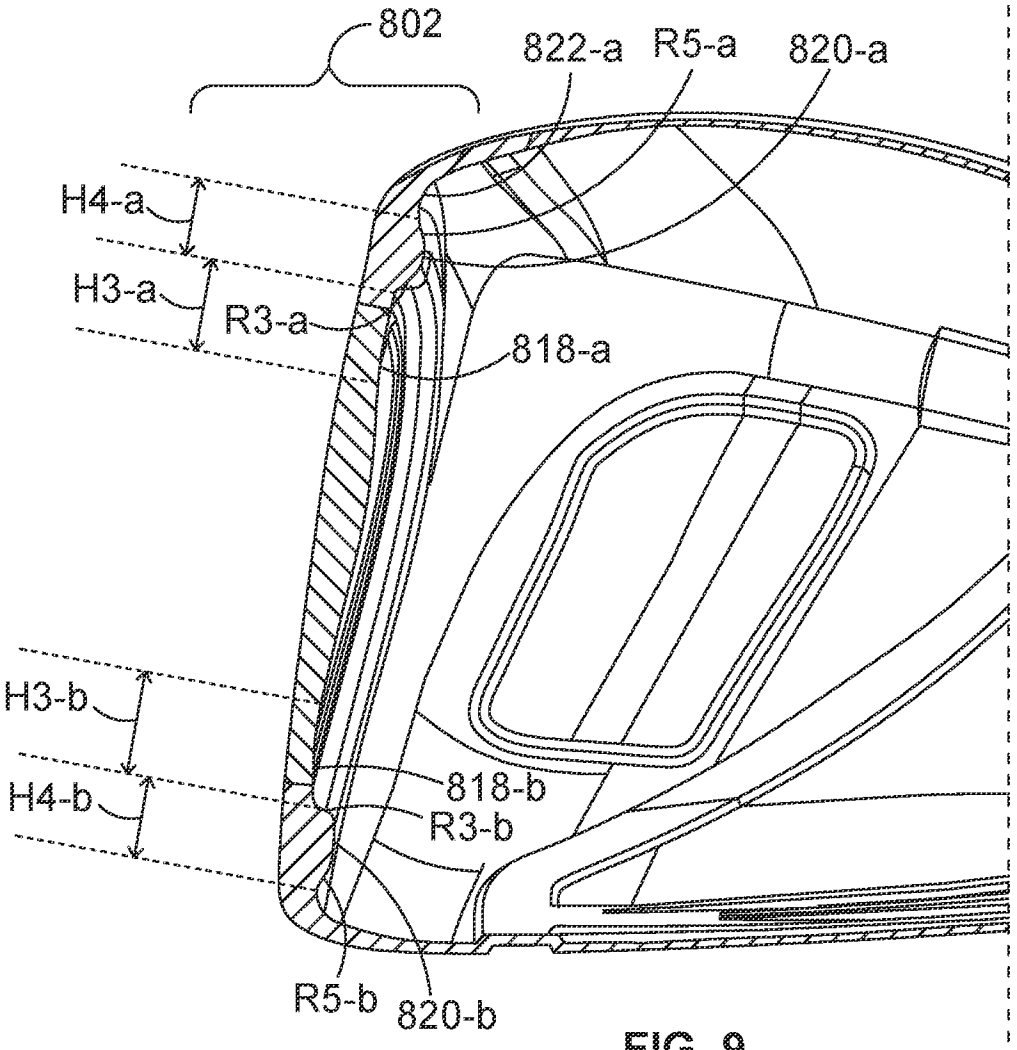
FIG. 9 of the accompanying drawings shows an enlarged cross-sectional view of a striking face portion of a golf club head in accordance with an alternative embodiment of the present invention shown in FIG. 8.

FIG. 9 of the accompanying drawings shows an enlarged view of the cross-sectional view of the striking face portion 802 of the golf club head 800 shown in FIG. 8. In this enlarged cross-sectional view, only the features that differentiate this embodiment of the present invention from prior embodiments have been highlighted. In this alternative embodiment of the present invention, the height H4-*a* of the upper thickened stress reducing region 820-*a* is no longer the same as height H4-*b* of the lower thickened stress reducing region 820-*b*. In fact, the height H4-*a* of the upper thickened stress reducing region 820-*a* is reduced to address stress raisers that often arise in the upper part of the striking face portion 802. Resultingly, due to the reduction in height H4-*a* of the upper thickened stress reducing region 820-*a*, the height H3-*a* of the upper thinned intermediate region 818-*a* is increased. In addition to the above, to further reduce the stress, the radius R3-*a* between the upper thickened stress reducing region 820-*a* and the upper thinned intermediate region 818-*a* is increased to create a more gradual blend at this location. Finally, unrelated to addressing the stress levels of the striking face portion 802, the radius R5-*a* between the upper thickened stress reducing region 820-*a* and the upper thinned perimeter region 822-*a* is also increased to soften the blend to allow for ease of manufacturability.

Diving into the numbers, the height H4-*a* of the upper thickened stress reducing region 820-*a* in accordance with this embodiment of the present invention, may generally be between about 3.1 mm to about 3.9 mm, more preferably between about 3.3 mm top about 3.7 mm, and most preferably about 3.5 mm, which is about 0.5 mm shorter than its counter part H4-*b* located at the lower thickened stress reducing region 820-*b*. The height H3-*a* of the upper thinned intermediate region 818-*a* in accordance with this current embodiment of the present invention, may generally be between about 6.5 mm to about 8.5 mm, more preferably between about 7.0 mm to about 8.0 mm, and most preferably about 7.5 mm, which makes it approximately the same as it's counter part H3-*b* located at the lower thinned intermediate region 818-*b*.

In addition to changes in the height, the radius R3-*a* and R5-*a* of the upper thickened stress reducing region 820-*a* have also been altered to be different from its counter part at the lower thickened stress reducing region 820-*b*. By increasing the radius of curvature of R3-*a*, the more gradual transition between the two neighboring components help eliminate stress risers that could occur at that portion of the striking face portion 802. The R3-*a* in accordance with this embodiment of the present invention may generally be greater than about 1.50 mm, more preferably greater than about 1.60 mm, and more preferably greater than about 1.70 mm. The radius of curvature R5-*a* on the other hand, is also increased to be more gradual, but this time for manufacturing reasons allowing for a less pronounced region of reduced casting flow. Thus R5-*a* in accordance with this embodiment of the present invention may generally be greater than about 1.50 mm, more preferably greater than about 1.60 mm, and more preferably greater than about 1.70 mm. Hence it is worth noting here that in this embodiment, it is critical that the radius of curvature of the transition of the upper thickened stress reducing region 820-*a* be greater than a radius of curvature of the transition of the lower thickened stress reducing region 820-*b*, as the striking face portion 802 often exhibits higher stress levels at that location.

Figure 10A:
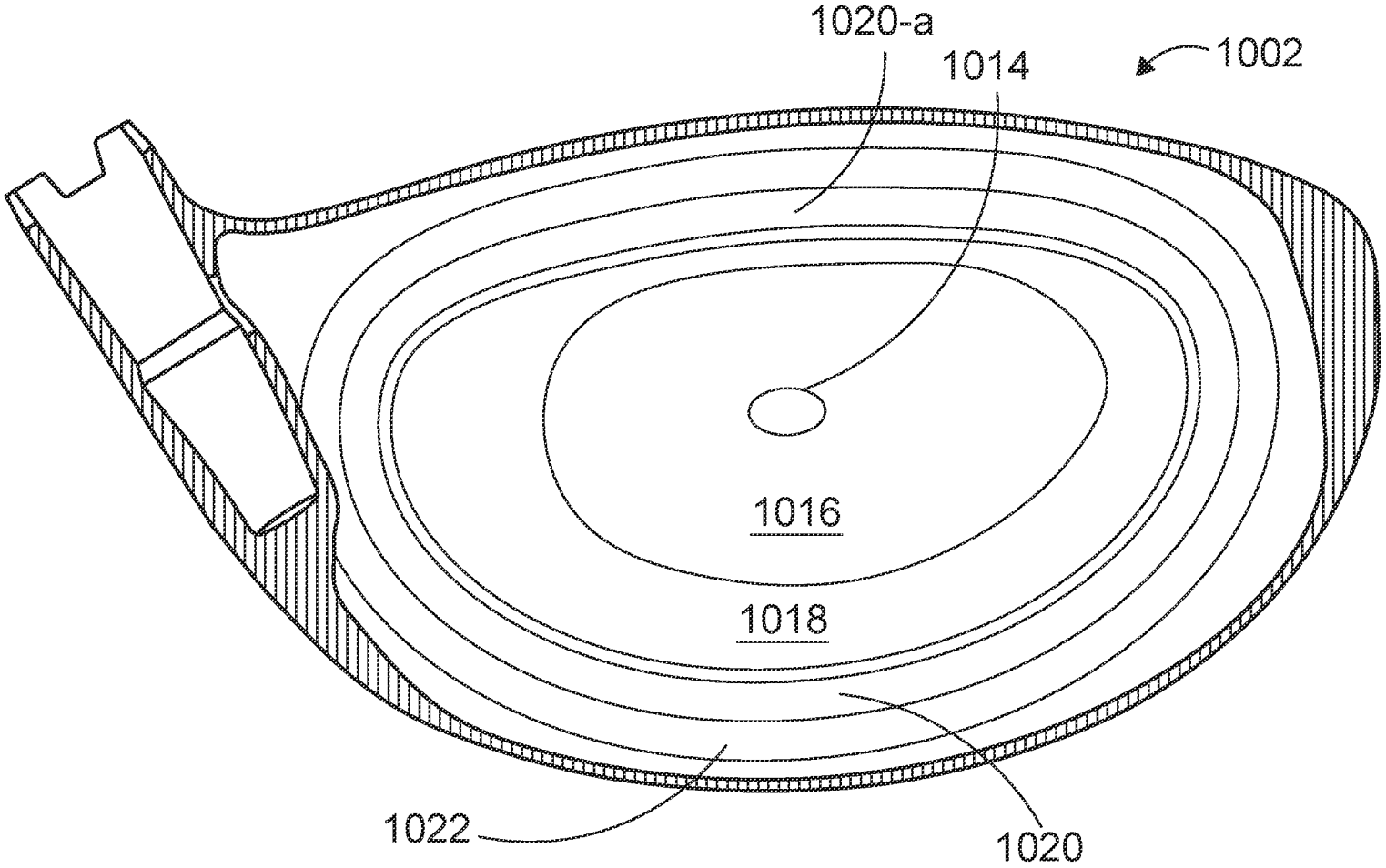
FIG. 10*a* of the accompanying drawings shows a rear shaded view of a striking face portion of a golf club head in accordance with an alternative embodiment of the present invention.
Figure 10B:
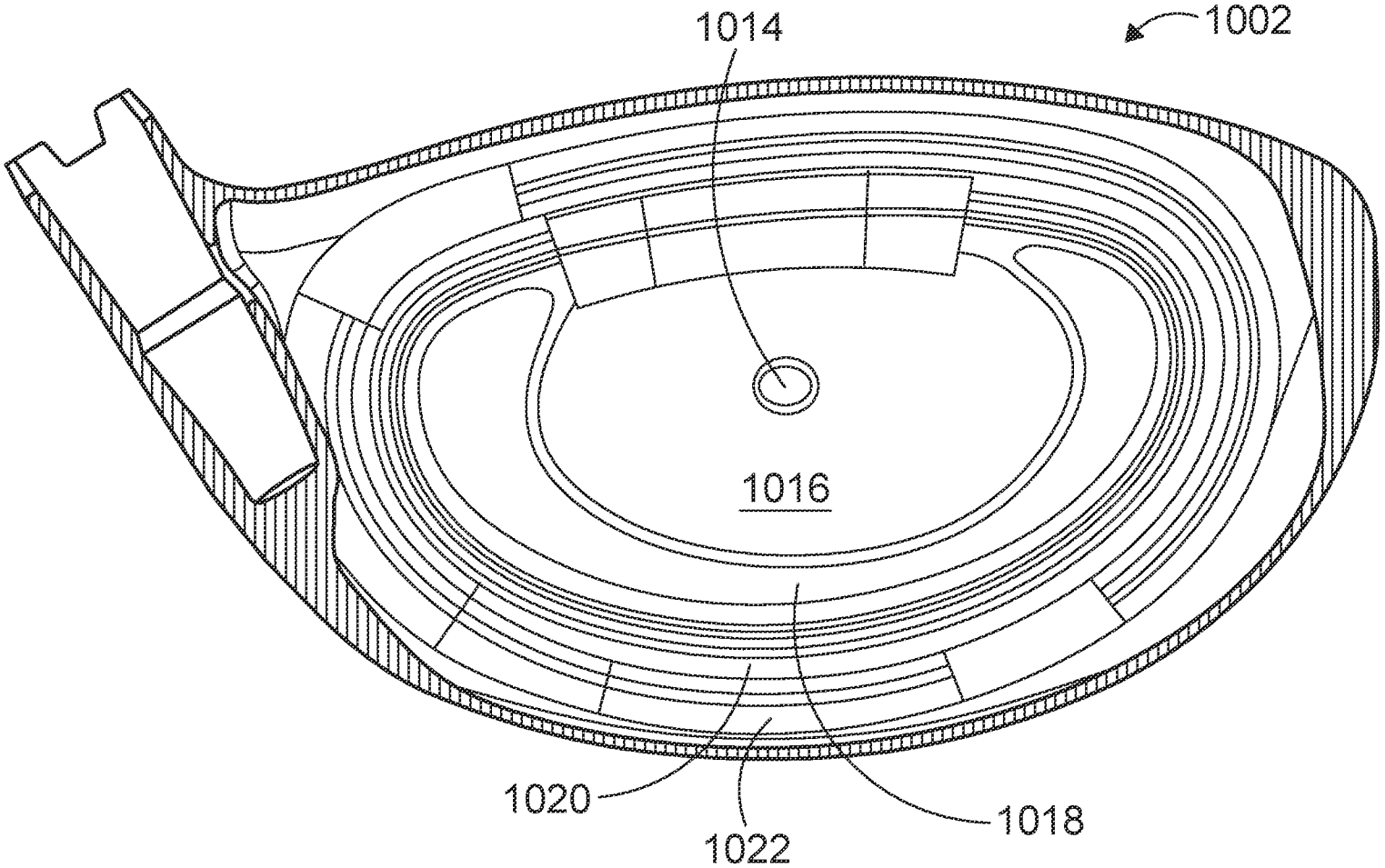
FIG. 10*b* of the accompanying drawings shows a rear view of a striking face portion of a golf club head in accordance with an alternative embodiment of the present invention.

FIGS. 10*a* and 10*b* show a rear view of the striking face portion 1002 of a golf club head in accordance with an exemplary embodiment of the present invention. In FIG. 10*a*, a shaded view is presented to provide a better visual of the various components of the striking face portion 1002. In this shaded view shown in FIG. 10*a* and the wireframe view shown in FIG. 10*b*, the adjustments to the upper thickened stress reducing region 1020-*a* can be seen, and its height H4-*a* (shown in FIG. 9) is smaller when compared to the remaining portions of the thickened stress reducing region 1020-*a*. Another thing worth noting here that was previously not mentioned is that in the current exemplary embodiment of the present invention, the entire thickened stress reducing region 1020 takes on the shape of a ring encircles the central portion of the striking face portion 1002. However, in alternative embodiments of the present invention, the thickened stress reducing region 1020 may not need to encircle the striking face portion 1002 completely and can partially surround the striking face portion without departing from the scope and content of the present invention. Alternatively speaking, the thickened stress reducing region 1020 may only encircle less than 360 degrees around the face, less than about 270 degrees around the face, less than 180 degrees around the face, all without departing from the scope and content of the present invention.

FIGS. 11 through 15 of the accompanying drawings shows a golf club head in accordance with a further alternative embodiments of the present invention, wherein the thickened stress reducing region is formed out of multiple materials to achieve the further improve upon the stress reducing capabilities of the thickened stress reducing region.

Figure 11:
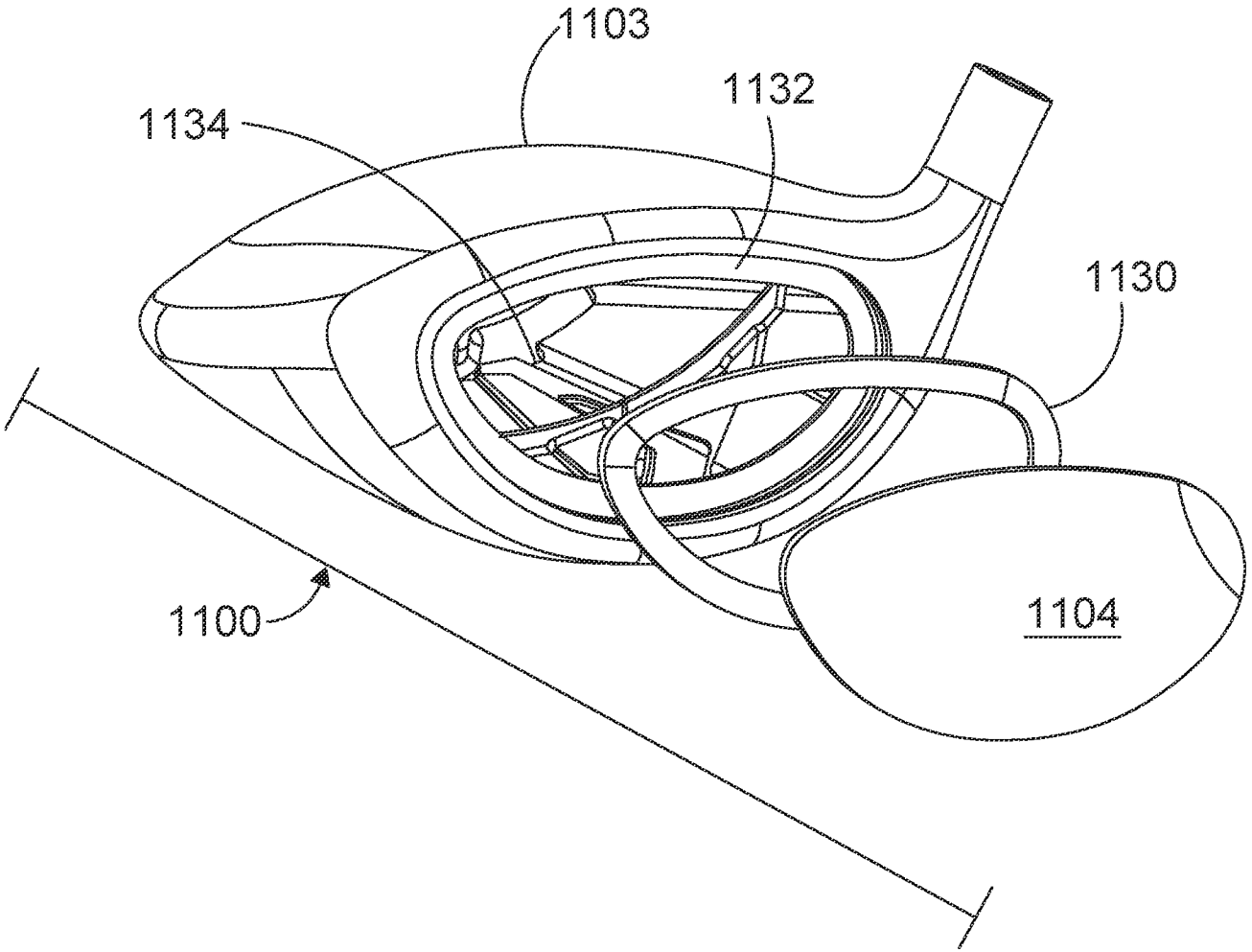
FIG. 11 of the accompanying drawings shows an exploded view of a golf club head in accordance with an even further alternative embodiment of the present invention.

FIG. 11 of the accompanying drawings shows an exploded perspective view of a golf club head 1100 in accordance with a further alternative embodiment of the present invention, wherein the thickened stress reducing region is further formed out of multiple materials. In this exploded cross-sectional view of the golf club head 1100 shown in FIG. 11, the body portion 1103 has a pocket 1134 with a perimeter ledge 1132, wherein the perimeter ledge 1132 helps receive a gasket 1130 and the gasket 1130 separates the face insert 1104 from the perimeter ledge 1132. The combination of the perimeter ledge 1132, the gasket 1130, and the perimeter of the face insert 1104 combine to create the thickened stress reducing region (shown in FIG. 12) in this embodiment of the present invention.

Figure 12:
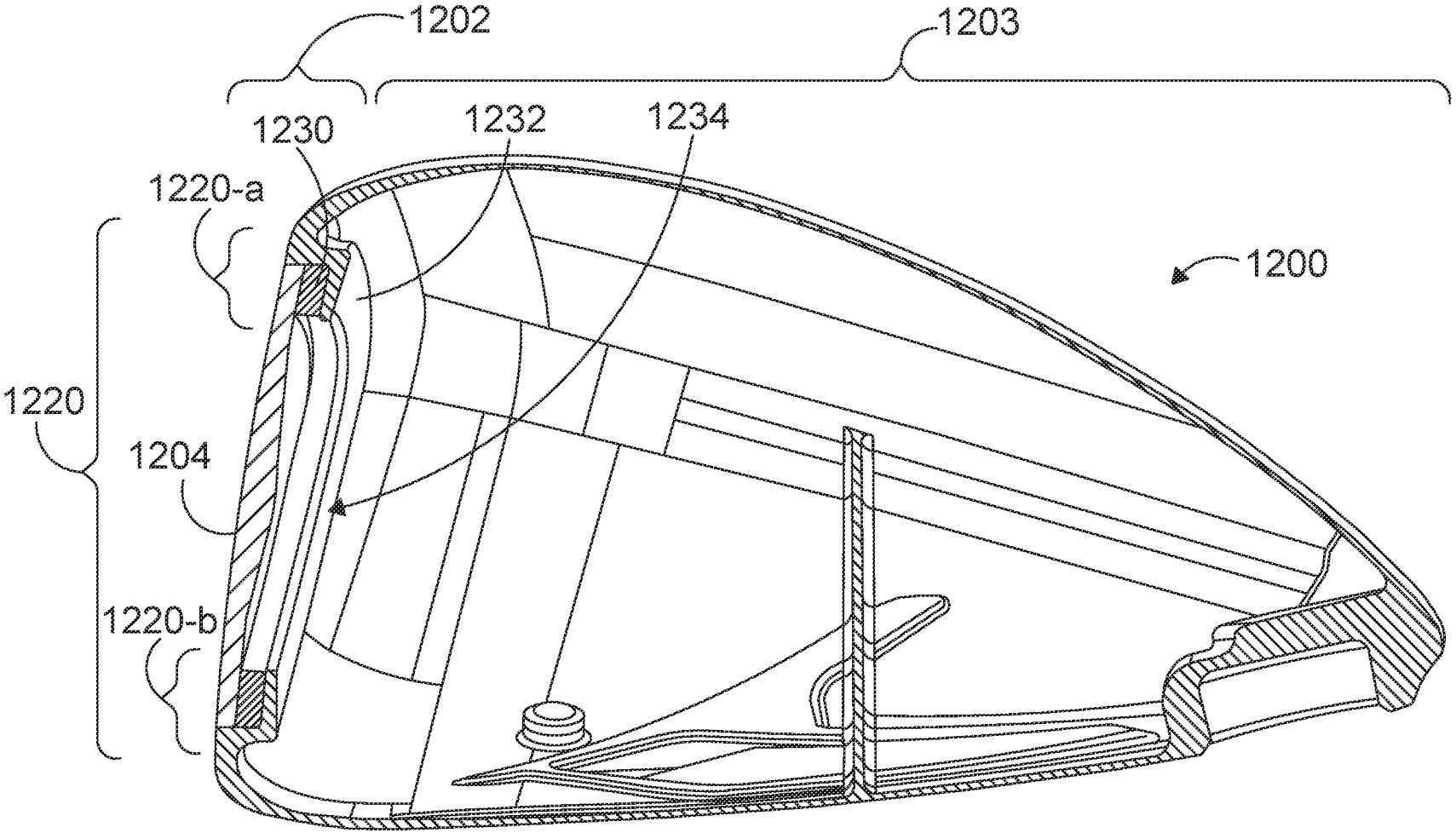
FIG. 12 of the accompanying drawings shows a cross-sectional view of a golf club head in accordance with the even further alternative embodiment of the present invention.

FIG. 12 of the accompanying drawings shows a cross-sectional view of a golf club head 1200 in accordance with an alternative embodiment of the present invention, taken along cross-sectional line A-A' shown in FIG. 1. In this cross-sectional view of the golf club head 1200, we can see that the golf club head 1200, similar to previous embodiments, can be split into a frontal striking face portion 1202 and a rear body portion 1203. The frontal striking face portion 1202 is further comprised out of an opening pocket 1234 adapted to receive a face insert 1204 like previous embodiments. However, in this embodiment of the present invention, instead of having the face insert 1204 being welded directly onto the perimeter of the pocket 1234 as it is commonly known in the industry, the opening pocket 1234 creates a perimeter ledge 1232 that is recessed from the external plane of the striking face, and the perimeter ledge 1232 is adapted to receive a gasket 1230 that separates face insert 1204 from the perimeter ledge 1232. In this cross-sectional view of the present invention, we can clearly see that the combination of the perimeter ledge 1232, the gasket 1230, and the perimeter of the face insert 1204 combine to create the thickened stress reducing region 1220. The thickened stress reducing region 1220 in this embodiment may further be defined as an upper thickened stress reducing region 1220-*a* and a lower thickened stress reducing region 1220-*b*, both of which have dimensional measurements similar to previous embodiments described previously.

In this embodiment of the present invention, the face insert 1204, gasket 1230, and perimeter ledge 1232 may generally be bonded together using some type of a glue adhesive. However, in alternative embodiments of the present invention, the three components that form the thickened stress reducing region 1220 that may have different material properties, may also rely on alternate bonding techniques such as brazing, swaging, or even mechanical fastening all without departing from the scope and content of the present invention so long as the face insert 1204 is not directly bonded to the perimeter ledge 1232 itself.

The material used to create the gasket 1230 is also critical in this embodiment of the present invention, as may help reduce stress around the perimeter of the frontal striking face portion 1202. In this embodiment, the material used to create the gasket may generally have a modulus of elasticity, or Young's modulus of between about 5 GPa and about 120 GPa, more preferably between about 10 GPa and about 80 GPa, and most preferably about 30 GPa. In addition to the above, the gasket 1230 may also have density of less than about 2,000 g/cc, more preferably less than about 1,900 g/cc, and most preferably less than about 1,800 g/cc, all without departing from the scope and content of the present invention.

Figure 13:
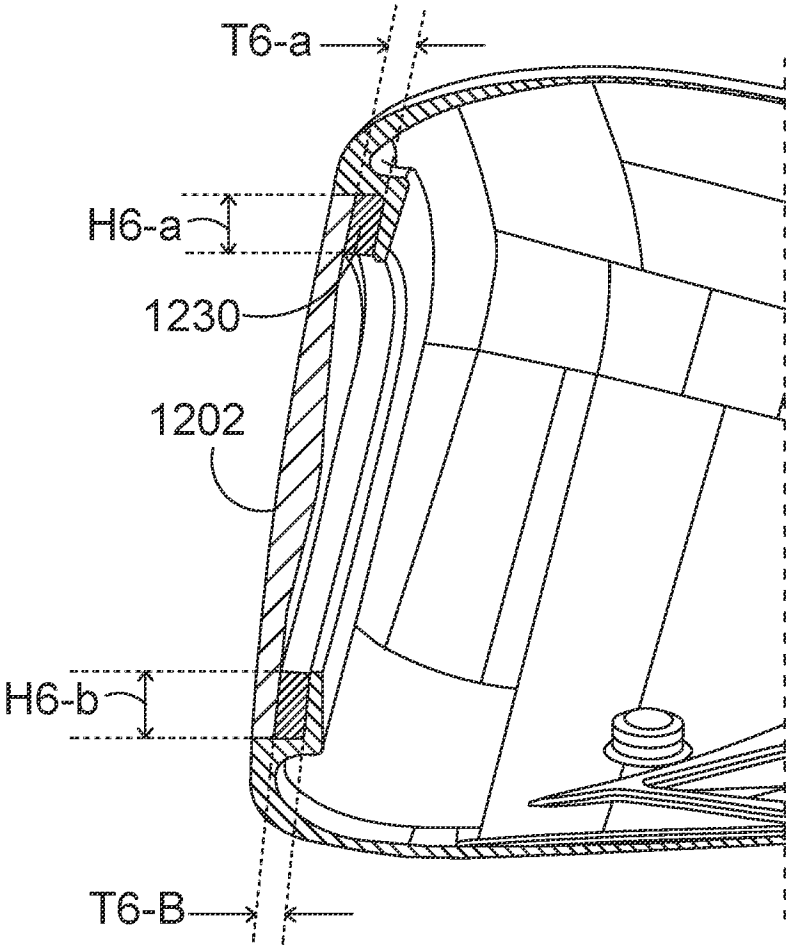
FIG. 13 of the accompanying drawings shows an enlarged cross-sectional view of a striking face portion of a golf club head in accordance with an even further alternative embodiment of the present invention.

In order to illustrate some of the dimensions of the gasket 1230 itself, an enlarged cross-sectional view of the striking face portion 1202 is provided in FIG. 13. In this view shown in FIG. 13, we can see that the gasket 1230 may have an upper gasket height H6-*a* and a lower gasket height H6-*b* that are approximately the same. H6-*a* and H6-*b* in accordance with this embodiment of the present invention may generally be between about 3.0 mm to about 7.0 mm, more preferably between about 4.0 mm to about 6.0 mm, and most preferably about 5.0 mm. FIG. 13 also shows the thickness T6 of the gasket, illustrated as an upper gasket thickness T6-*a* and a lower gasket thickness T6-*b*, both of which are approximately the same in this embodiment of the present invention. Hence, T6-*a* and T6-*b* in accordance with this embodiment of the present invention may generally be between about 0.3 mm to about 0.7 mm, more preferably between about 0.4 mm to about 0.6 mm, and most preferably about 0.5 mm.

Based on the thickness and height measurements above, it can be said that the gasket 1230 may have a T over H Ratio defined by Equation (2) below:

$$T \text{ over } H \text{ Ratio} = \frac{\text{Thickness of } T6 \text{ of Gasket}}{\text{Height of } H6 \text{ of Gasket}} \qquad \text{Eq. (2)}$$

The T over H Ratio of the gasket 1230 may generally be between about 0.04 and about 0.23, more preferably between about 0.06 to about 0.15, and most preferably about 0.1.

It should also be noted that although the thickness and height of the gasket 1230 is the same for the upper portion of the gasket 1230 and the lower portion of the gasket 1230, the thickness and height of the gasket could be different from one another without departing from the scope and content of the present invention. In one exemplary embodiment, the upper portion of the gasket 1230 could be thicker while the lower portion of the gasket 1230 could be thinner, to help the striking face portion 1202 deflect more downward upon impact with a golf ball to reduce lower launch and spin without departing from the scope and content of the present invention. Needless to say, if the thickness of the gasket 1230 are to be manipulated, the depth of the perimeter ledge 1232 is generally adjusted accordingly to create a seamless flush look of the golf club head in its resting neutral position. Alternatively, the thickness of the material could be maintained, but the modulus adjusted to achieve the same effects without departing from the scope and content of the present invention.

Figure 14:
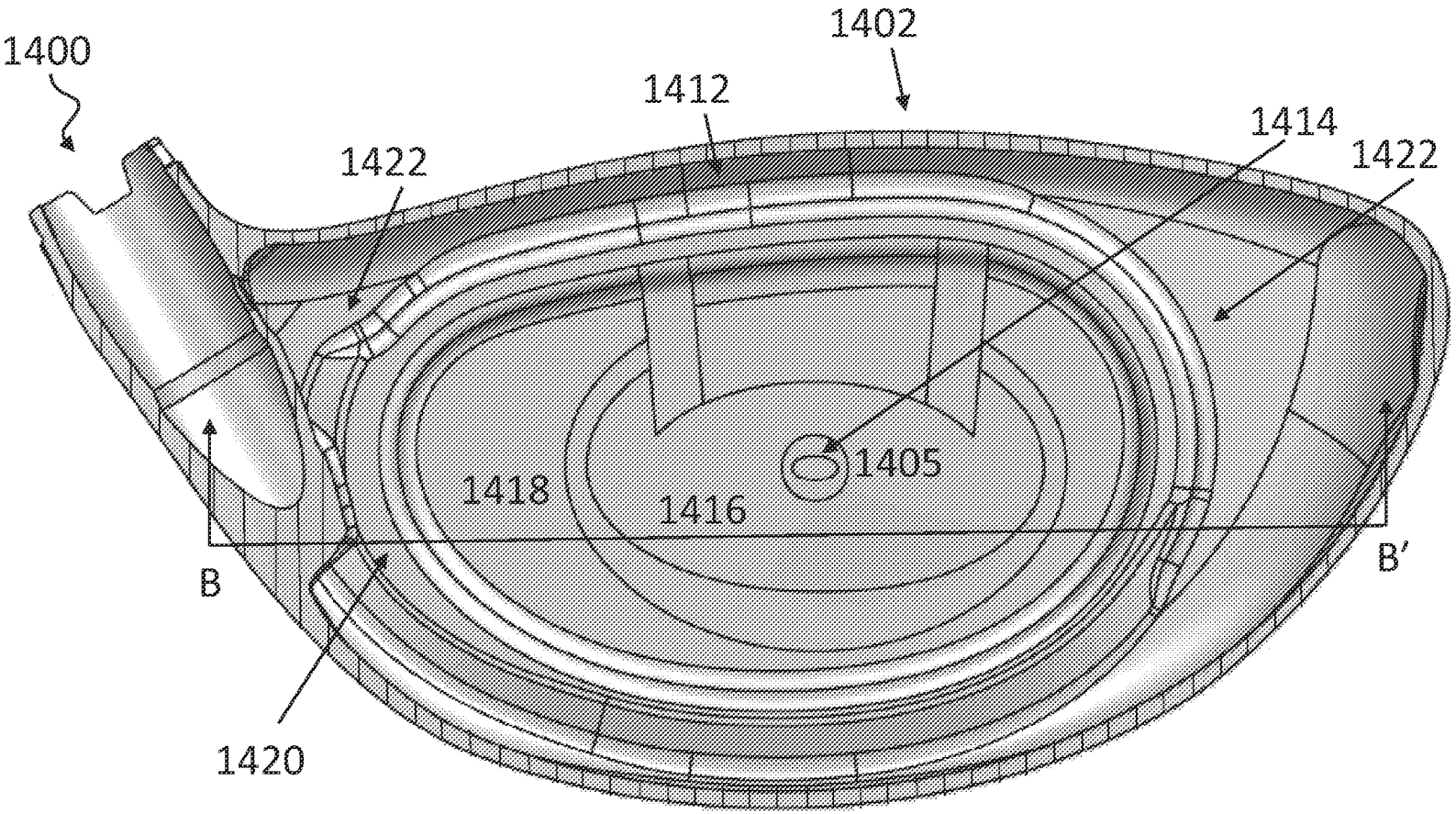
FIG. 14 illustrates a cross-sectional rear view of a golf club head, allowing cross-sectional line A-A' to be shown, in accordance with an embodiment of the presently disclosed technology.

FIG. 14 illustrates a cross-sectional rear view of a golf club head, in accordance with an embodiment of the presently disclosed technology. FIG. 14 may be illustrated in a shaded view to provide a better visual of various components. In FIG. 14, golf club head 1400 may include a striking face portion 1402. The striking face portion 1402 may be formed by the thickness created by a substantially planar frontal striking surface and a rear internal surface 1412. The striking face portion 1402 may include a geometric face center 1405 a thickened central region 1414, a central transition region 1416, a thinned intermediate region 1418, a thickened stress reducing region 1420, and a thinned perimeter region 1422. Thickened central region 1414 may surround the geometric face center 1405. In embodiments, thickened central region 1414 may be offset from the geometric face center 1405 by an offset distance. The center of thickened central region 1414 may be defined by an offset center point, taking the offset distance from the geometric face center. The offset distance may include a heelward component, a toeward component, a crownward component, and/or a soleward component. As used herein, heelward may mean toward a heel of golf club head 1400, toeward may mean toward a toe of golf club head 1400, crownward, upward, and/or topward may mean toward a crown of golf club head 1400, and soleward, downward and/or bottomward may mean toward a sole of golf club head 1400. In some embodiments, the offset distance may be more heelward/toeward than crownward/soleward. In some embodiments, the offset distance may be measured along x-, y-, and/or z-axes, and the values disclosed herein may apply with equal force using these coordinate systems and/or locations. The offset distance may be measured by taking a distance of a center of the thickened central region 1414 from geometric face center 1405. The offset distance may be between about 0.1 mm and about 14.0 mm. In embodiments, the center of the thickened stress reducing region 1420 may be measured by finding the thickest portion of the thickened stress reducing region 1420 and taking the center of this thickest portion. For example, this may be the apex of the thickened stress reducing region 1420. In some embodiments, the center of the thickened stress reducing region 1420 may be measured at loft, that is along the plane of the striking face. The offset distance and other areas of the striking face portion 1402, including geometric face center 1405, thickened central region 1414, central transition region 1416, thinned intermediate region 1418, thickened stress reducing region 1420, and thinned perimeter region 1422 may be measured at loft. In some embodiments, these distances and/or locations may be measured along x-, y-, or z-axes. Offsetting the location of the thickened central region 1414 may affect golf club performance. For example, this may increase ball speed on the center of the face, maintain ball speed along the center of the face, maintain ball speed around the center of the face, improve the dispersion of mishits, and other benefits. It should be appreciated that the disclosed offset distance is critical to the presently disclosed technology.

Outward from the thickened central region 1414 may be central transition region 1416. Central transition region 1416 may be offset from a geometric center by the offset distance. In some embodiments, central transition region 1416 may not be offset. In embodiments, the central transition region 1416 may be offset by another offset distance. The second offset distance may define a second offset center point.

Outward from central transition region 1416 may be thinned intermediate region 1418. Thinned intermediate region 1418 may be offset from a geometric center by the offset distance. In some embodiments, the thinned intermediate region 1418 may not be offset. In embodiments, the thinned intermediate region 1418 may be offset by another offset distance.

Outward from thinned intermediate region 1418 may be thickened stress reducing region 1420. Thickened stress reducing region 1420 may be offset from a geometric center by the offset distance. In some embodiments, the thickened stress reducing region 1420 may not be offset. In embodiments, the thickened stress reducing region 1420 may be offset by another offset distance.

Outward from thickened stress reducing region 1420 may be thinned perimeter region 1422. Thinned perimeter region 1422 may be offset from a geometric center by the offset distance. In some embodiments, the thinned perimeter region 1422 may not be offset. In embodiments, the thinned perimeter region 1422 may be offset by another offset distance.

In some embodiments, thickened central region 1414 and/or central transition region 1416 may be offset by the offset distance. Thinned intermediate region 1418, thickened stress reducing region 1420, and/or thinned perimeter region 1422 may be offset by the offset distance. In embodiments, offset distance may be greater than offset distance. For example, offset distance may be between about 1 mm and about 5 mm, and offset distance may be between about 0.1 mm to about 3 mm. Each of these regions may include heights, thicknesses, and radii of the various components located on the face.

Figure 15:
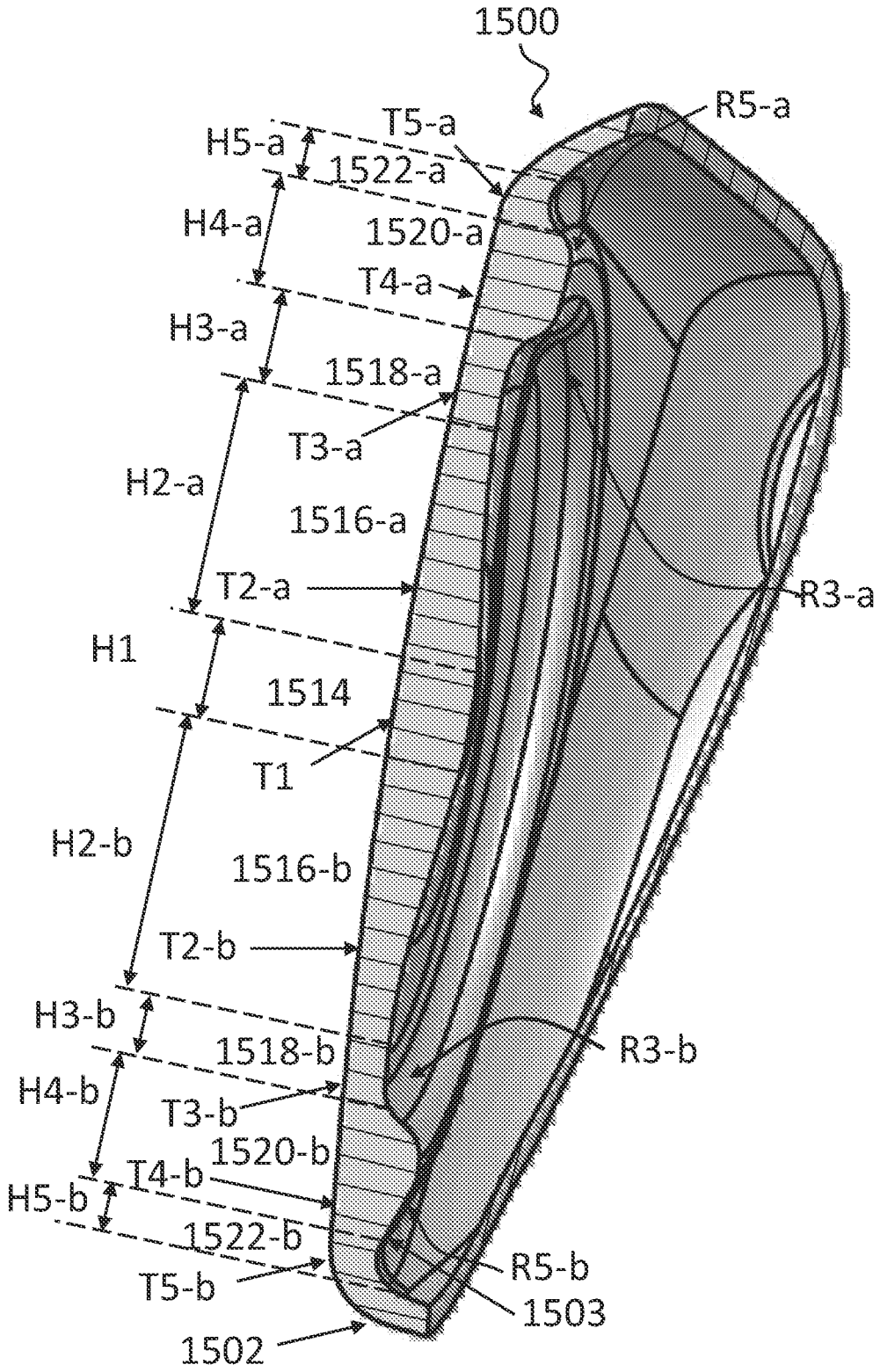
FIG. 15 illustrates a cross-sectional view of a golf club head 1500, taken along cross-sectional line A-A' shown in FIG. 1, in accordance with an embodiment of the presently disclosed technology.
Figure 16:
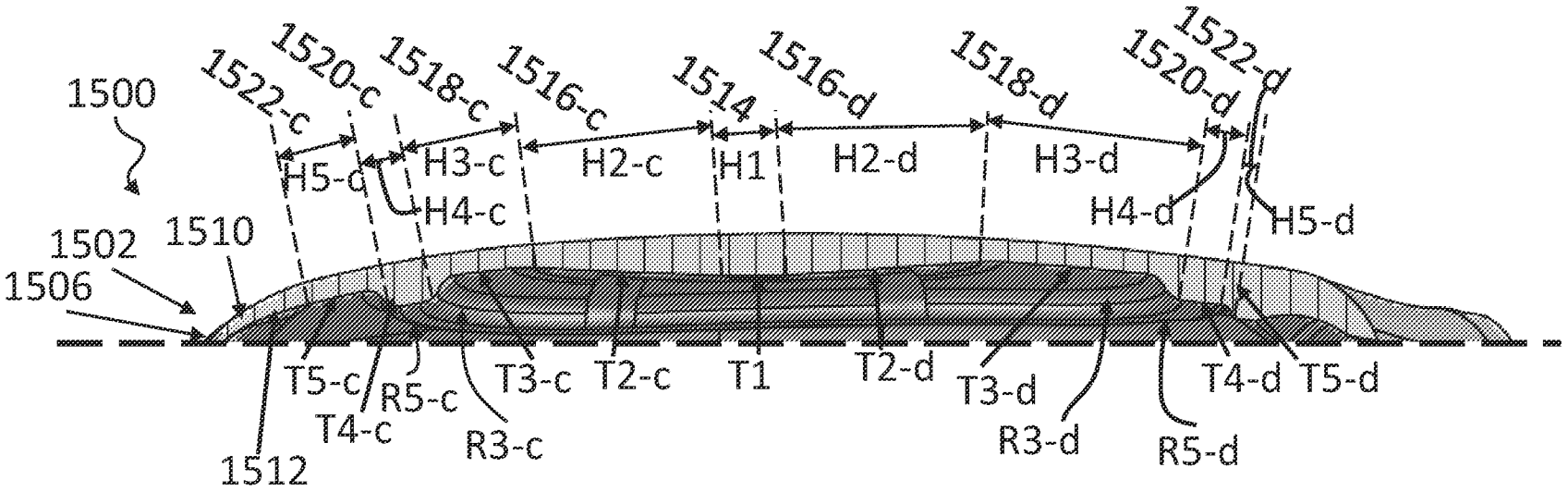
FIG. 16 illustrates a cross-sectional view of a golf club head 1500, taken along cross-sectional line B-B' shown in FIG. 14, in accordance with an embodiment of the presently disclosed technology.

FIGS. 15 and 16 illustrate a cross-sectional view of a golf club head 1500, taken along cross-sectional line A-A' shown in FIG. 1 and B-B' shown in FIG. 14, respectively. Golf club head 1500 may include a striking face portion 1502 and a rear body portion 1503, attached to the rear of the striking face portion 1502. The striking face portion 1502 may refer to the portion of the golf club head 1500 that is substantially planar, and located at the frontal portion of the golf club head 1500, adapted to strike a golf ball. The striking face portion 1502 may be formed by the thickness created by a substantially planar frontal striking surface 1510 and a rear internal surface 1512 having a variable contour, thus creating a striking face portion with a variable face thickness profile. The demarcation between the striking face portion 1502 and the rear body portion 1503 may occur when the rear internal surface 1512 deviates from a substantially planar vertical orientation towards a substantially horizontal orientation.

Golf club head 1500 may include a face insert that may close an opening in the striking face portion 1502 created by the face perimeter 1506. The face insert may be made from a metal or a composite. For example, a titanium material may be used for its light weight and high durability characteristics. Striking face portion 1502 may generally be significantly thinner than traditional golf club heads having a similar construction due to the unique thickened stress reducing region 1520 around the face perimeter 1506. In embodiments, the thickened stress reducing region 1520 around the face perimeter 1506 may allow for the face insert to be thinner and lighter, yielding a mass of less than about grams. In some embodiments, the mass may be less than about 20 grams. In embodiments, the mass may be less than about 19.6 grams, all without departing from the scope and content of the presently disclosed technology. Compared to a face insert installed without the thickened stress reducing region 1520 around the face perimeter 1506, the mass of the face insert may be decreased.

The striking face portion 1502 may include thickened central region 1514. Located outward from thickened central region 1514, the striking face portion 1502 may include an upper central transition region 1516-*a*, a lower central transition region 1516-*b*, toeward central transition region 1516-*c*, and heelward central transition region 1516-*d*, combining to form the central transition region 1516. Located outward from the central transition region 1516, the striking face portion 1502 may include an upper thinned intermediate region 1518-*a*, a lower thinned intermediate region 1518-*b*, toeward thinned intermediate region 1518-*c*, and heelward thinned intermediate region 1518-*d*, combining to form a thinned intermediate region 1518. Located outward from the thinned intermediate region 1518, the striking face portion 1502 may include an upper thickened stress reducing region 1520-*a*, a lower thickened stress reducing region 1520-*b*, toeward thickened stress reducing region 1520-*c*, and heelward thickened stress reducing region 1520-*d*, combining to form a thickened stress reducing region 1520. The thickened stress reducing region 1520 may be discussed as forming a ring that protrudes rearward from the internal surface 1512 of the striking face portion 1502. In some embodiments, the thickened stress reducing region 1520 may be discussed as protruding rearward from the internal surface 1512 of the striking face portion 1502. For example, the thickened stress reducing region 1520 may be the thickest part of the striking face portion 1502. Located outward from the thickened stress reducing region 1520, striking face portion 1502 may include an upper thinned perimeter region 1522-*a*, a lower thinned perimeter region 1522-*b*, toeward thinned perimeter region 1522-*c*, and heelward thinned perimeter region 1522-*d*, combining to form a thinned perimeter region 1522.

The height H1 of the thickened central region 1514 may be between about 4.0 mm and about 20.0 mm. In some embodiments, the height H1 may be between about 8.0 mm and about 16.0 mm. In embodiments, the height H1 may be about 15.0 mm.

The height of the central transition region 1516 may be greater below the thickened central region 1514 than above the thickened central region 1514. For example, height H2-*a* may be smaller than height H2-*b*. Part of the difference in height between the upper and lower central transition regions may be based on the offset distance. For example, the height H2-*a* of the upper central transition region 1516-*a* may be between about 5.0 mm and about 12.0 mm. In some embodiments, the height H2-*a* may be between about 7.0 mm and about 10.0 mm. In embodiments, the height H2-*a* may be about 8.5 mm. The height H2-*b* of the lower central transition region 1516-*b* may be between about 5.5 mm to about mm. In some embodiments, the height H2-*b* may be between about 8.0 mm to about 12.0 mm. In embodiments, the height H2-*b* may be about 9.8 mm. It should be appreciated that the height of the upper central transition region 1516-*a* and the lower central transition region 1516-*b* may be the same without departing from the scope and content of the presently disclosed technology.

The height of the central transition region 1516 may be greater heelward of the thickened central region 1514 than toeward of the thickened central region 1514. For example, height H2-*c* of a toeward central transition region 1516-*c* may be smaller than height H2-*d* of a heelward central transition region 1516-*d*. Part of the difference in height between the heelward and toeward central transition regions may be based on the offset distance. For example, the offset distance may be 4.0 mm heelward and 0.5 mm crownward. In one example, the offset distance may include a heelward component of about 2.5 mm and a crownward component of about 2.0 mm. In some embodiments, the heelward/toeward component may be smaller in value than the crownward/soleward component. In embodiments, the heelward component or toeward component may be a distance between about 2.0 and about 10.0 mm and/or the crownward component or soleward component may be a distance between about 0.1 and about 5 mm. In one example, the height H2-*c* of the toeward central transition region 1516-*c* may be between about 5.0 mm and about 12.0 mm. In some embodiments, the height H2-*c* may be between about 7.0 mm and about 10.0 mm. In embodiments, the height H2-*c* may be about 8.5 mm. The height H2-*d* of the heelward central transition region 1516-*d* may be between about 5.5 mm to about 15.0 mm. In some embodiments, the height H2-*d* may be between about 8.0 mm to about 12.0 mm. In embodiments, the height H2-*d* may be about 9.8 mm. It should be appreciated that the height of the toeward central transition region 1516-*c* and the heelward central transition region 1516-*d* may be different without departing from the scope and content of the presently disclosed technology.

The height of the thinned intermediate region 1518 may be greater below the thickened central region 1514 than above the thickened central region 1514. For example, height H3-*a* may be smaller than height H3-*b*. In embodiments, height H3-*a* in addition to height H2-*a*, that is height H3-*a* plus height H2-*a*, may be less than height H3-*b* in addition to height H2-*b*. In some embodiments, the opposite may be true; that is, the height of the thinned intermediate region 1518 may be greater above the thickened central region 1514 than below the thickened central region 1514. Part of the difference in height between the upper and lower thinned intermediate regions may be based on the offset distance. For example, the height H3-*a* of the upper thinned intermediate region 1518-*a* may be between about 20.0 mm to about 40.0 mm. In some embodiments, the height H3-*a* may be between about 25.0 mm to about 35.0 mm. In embodiments, the height H3-*a* may be about 26.0 mm. In embodiments, the height H3-*a* may be about 30.0 mm. The height H3-*b* of the lower thinned intermediate region 1518-*b* may be between about 20.5 mm to about 40.5 mm. In some embodiments, the height H3-*b* may be between about 25.5 mm to about 35.5 mm. In embodiments, the height H3-*b* may be about 26.5 mm. In embodiments, the height H3-*b* may be about 30.5 mm. It should be appreciated that the height of the upper thinned intermediate region 1518-*a* and the lower thinned intermediate region 1518-*b* may be the same without departing from the scope and content of the presently disclosed technology.

The height of the thinned intermediate region 1518 may be greater heelward of the thickened central region 1514 than toeward of the thickened central region 1514. For example, height H3-*d* of a heelward thinned intermediate region 1518-*d* may be larger than height H3-*c* of toeward thinned intermediate region 1518-*c*. In embodiments, height H3-*c* in addition to height H2-*c* may be less than height H3-*d* in addition to height H2-*d*. In some embodiments, the opposite may be true. Part of the difference in height between the heelward and toeward thinned intermediate regions may be based on the offset distance. For example, the height H3-*c* of the toeward thinned intermediate region 1518-*c* may be between about 4.0 mm to about 20.0 mm. In some embodiments, the height H3-*c* may be between about 6.0 mm to about 15.0 mm. In embodiments, the height H3-*c* may be about 8.0 mm. The height H3-*d* of the heelward thinned intermediate region 1518-*d* may be between about 10.0 mm to about 30.0 mm. In some embodiments, the height H3-*d* may be between about 12.0 mm to about 20.0 mm. In embodiments, the height H3-*d* may be about mm. It should be appreciated that the height of the toeward thinned intermediate region 1518-*c* and the heelward thinned intermediate region 1518-*d* may be the same without departing from the scope and content of the presently disclosed technology.

The height of the thickened stress reducing region 1520 may be the same measurement irrespective of whether the measurement is for the upper thickened stress reducing region 1520-*a*, the lower thickened stress reducing region 1520-*b*, the toeward thickened stress reducing region 1520-*c*, or the heelward thickened stress reducing region 1520-*d*. For example, the heights H4-*a*, H4-*b*, H4-*c*, and H4-*d* may be between about 4.0 mm and about 6.0 mm. In some embodiments, the heights H4-*a*, H4-*b*, H4-*c*, and H4-*d* may be between about 4.5 mm and about 5.5 mm. In embodiments, the heights H4-*a*, H4-*b*, H4-*c*, and H4-*d* may be about 5.0 mm. It should be appreciated that having different H4-*a*, H4-*b*, H4-*c*, and H4-*d* values also does not deviate from the scope and content of the presently disclosed technology, so long as both fall within the ranges disclosed above. In some embodiments, height H4-*a* of thickened stress reducing region 1520 in addition to height H3-*a* of thinned intermediate region 1518 in addition to height H2-*a* of central transition region 1516 may be greater than height H4-*b* of thickened stress reducing region 1520 in addition to height H3-*b* of thinned intermediate region 1518 in addition to height H2-*b* of central transition region 1516. Height H4-*d* of heelward thickened stress reducing region 1520-*d* in addition to height H3-*d* of heelward thinned intermediate region 1518-*d* in addition to height H2-*d* of heelward central transition region 1516-*d* may be greater than height H4-*c* of toeward thickened stress reducing region 1520-*c* in addition to height H3-*c* of toeward thinned intermediate region 1518-*c* in addition to height H2-*c* of toeward central transition region 1516-*c*. It should be appreciated that the opposite may be true. It is worth noting here that the height of the thickened stress reducing region 1520 is critical to the proper functionality of the presently disclosed technology, as it carefully balances the need to reduce unnecessary mass to the striking face portion 1502, but also the need to provide enough structural rigidity to reduce the stress from the face perimeter 106 (shown in FIG. 1) to allow the remainder of the striking face portion 1502 to be made thinner and more efficient. The height of the thickened stress reducing region 1520, combined with the thickness of the thickened stress reducing region 1520 may outline the optimized geometry to achieve the performance gains of the present disclosure.

The height of the thinned perimeter region 1522 may be greater below the thickened central region 1514 than above the thickened central region 1514. For example, height H5-*a* may be smaller than height H5-*b*. In embodiments, height H5-*a* in addition to height H4-*a*, height H3-*a*, and height H2-*a* may be less than height H5-*b* in addition to height H4-*b*, height H3-*b*, and height H2-*b*. In some embodiments, the opposite may be true. Part of the difference in height between the upper and lower thinned perimeter regions may be based on the offset distance. For example, the height H5-*a* of the upper thinned perimeter region 1522-*a* may be between about 0.1 mm to about 10.0 mm. In some embodiments, the height H5-*a* may be between about 1.0 mm to about 8.0 mm. In embodiments, the height H5-*a* may be about 1.7 mm. The height H5-*b* of the lower thinned perimeter region 1522-*b* may be between about 0.5 mm to about 10.5 mm. In some embodiments, the height H5-*b* may be between about 1.5 mm to about 8.5 mm. In embodiments, the height H5-*b* may be about 2.0 mm. It should be appreciated that the height of the upper thinned perimeter region 1522-*a* and the lower thinned perimeter region 1522-*b* may be the same without departing from the scope and content of the presently disclosed technology.

The height of the thinned perimeter region 1522 may be greater toeward of the thickened central region 1514 than heelward of the thickened central region 1514. For example, height H5-*d* of heelward thinned perimeter region 1522-*d* may be smaller than height H5-*c* of toeward thinned perimeter region 1522-*c*. In some embodiments, there may not be any height on toeward thinned perimeter region 1522-*c* and/or heelward thinned perimeter region 1522-*d*. In embodiments, height H5-*d* in addition to height H4-*d*, height H3-*d*, and height H2-*d* may be less than height H5-*c* in addition to height H4-*c*, height H3-*c*, and height H2-*c*. In some embodiments, the opposite may be true. Part of the difference in height between the heelward and toeward thinned perimeter regions may be based on the offset distance. For example, the height H5-*c* of the toeward thinned perimeter region 1522-*c* may be between about 0.5 mm to about 10.5 mm. In some embodiments, the height H5-*c* may be between about 1.0 mm to about 5.0 mm. In embodiments, the height H5-*c* may be about 2.5 mm. The height H5-*d* of the heelward thinned perimeter region 1522-*d* may be between about 0.1 mm to about 10.0 mm. In some embodiments, the height H5-*d* may be between about 0.3 mm to about 2.0 mm. In embodiments, the height H5-*d* may be about 1.0 mm. It should be appreciated that the height of the toeward thinned perimeter region 1522-*c* and the heelward thinned perimeter region 1522-*d* may be the same without departing from the scope and content of the presently disclosed technology.

With respect to the thicknesses of striking face portion 1502, thickened central region 1514 may have a thickness T1 of less than about 5.0 mm. In some embodiments, it may be less than about 4.0 mm. For example, it may be about 3.8 mm. This is critical to the presently disclosed technology as this thickness T1 minimizes the thickness of various components of striking face portion 1502, via the introduction of the thickened stress reducing region 1520 that may alleviate stress on the striking face portion 1502.

The thickness of the central transition region 1516 may be variable. It may thin out from thickened central region 1514 linearly or non-linearly. For example, central transition region 1516 may linearly thin toward thinned intermediate region 1518 from thickened central region 1514. In one example, central transition region 1516 may non-linearly thin toward thinned intermediate region 1518 from thickened central region 1514. In one example, central transition region 1516 may non-linearly thin toward thinned intermediate region 1518 from thickened central region 1514 for a first central transition region height and linearly thin toward thinned intermediate region 1518 from thickened central region 1514 for a second central transition region height. In some embodiments, the upper central transition region 1516-*a* and the lower central transition region 1516-*b* may have the same thicknesses throughout the height. In embodiments, the upper central transition region 1516-*a* and the lower central transition region 1516-*b* may have different thicknesses. In some embodiments, the upper central transition region 1516-*a* may be linear and the lower central transition region 1516-*b* may be non-linear or other combinations without departing from the spirit and scope of the presently disclosed technology. In embodiments, the thickest part of thickness T2-*a* and thickness T2-*b* may be less than about 5.0 mm. In some embodiments, the thickest part of thickness T2-*a* and thickness T2-*b* may be less than about 4.0 mm. For example, the thickest part of thickness T2-*a* and thickness T2-*b* may be about 3.8 mm. In embodiments, the thinnest part of thickness T2-*a* and thickness T2-*b* may be greater than about 1.0 mm. In some embodiments, the thinnest part of thickness T2-*a* and thickness T2-*b* may be greater than about 1.5 mm. For example, the thinnest part of thickness T2-*a* and thickness T2-*b* may be about 2.0 mm. In some embodiments, the toeward central transition region 1516-*c* and the heelward central transition region 1516-*d* may have the same thicknesses throughout the height. In embodiments, the toeward central transition region 1516-*c* and the heelward central transition region 1516-*d* may have different thicknesses. In some embodiments, the toeward central transition region 1516-*c* may be linear and the heelward central transition region 1516-*d* may be non-linear or other combinations without departing from the spirit and scope of the presently disclosed technology. In embodiments, the thickest part of thickness T2-*c* and thickness T2-*d* may be less than about 5.0 mm. In some embodiments, the thickest part of thickness T2-*c* and thickness T2-*d* may be less than about 4.0 mm. For example, the thickest part of thickness T2-*c* and thickness T2-*d* may be about 3.8 mm. In embodiments, the thinnest part of thickness T2-*c* and thickness T2-*d* may be greater than about 1.0 mm. In some embodiments, the thinnest part of thickness T2-*c* and thickness T2-*d* may be greater than about 1.5 mm. For example, the thinnest part of thickness T2-*c* and thickness T2-*d* may be about 2.0 mm.

The thickness of the thinned intermediate region 1518 may be the same for the upper thinned intermediate region 1518-*a* and the lower thinned intermediate region 1518-*b*. For example, the thickness T3-*a* and thickness T3-*b* may both be less than about 3.0 mm. In some embodiments, the thickness T3-*a* and thickness T3-*b* may both be less than about 2.5 mm. In embodiments, the thickness T3-*a* and thickness T3-*b* may both be less than about 2.3 mm. In some embodiments, the thickness T3-*a* and thickness T3-*b* may be different from one another without departing from the spirit and scope of the presently disclosed technology, so long as both fall within the ranges disclosed above. For example, thickness T3-*a* may be about 2.3 mm and thickness T3-*b* may be about 2.0 mm. The thickness of the thinned intermediate region 1518 may be the same for the toeward thinned intermediate region 1518-*c* and the heelward thinned intermediate region 1518-*d*. For example, the thickness T3-*c* and thickness T3-*d* may both be less than about 3.0 mm. In some embodiments, the thickness T3-*c* and thickness T3-*d* may both be less than about 2.5 mm. In embodiments, the thickness T3-*c* and thickness T3-*d* may both be less than about 2.3 mm. In some embodiments, the thickness T3-*c* and thickness T3-*d* may be different from one another without departing from the spirit and scope of the presently disclosed technology, so long as both fall within the ranges disclosed above. For example, thickness T3-*c* may be about 2.3 mm and thickness T3-*d* may be about 2.0 mm.

The thicknesses of the thickened stress reducing region 1520, shown here as an upper thickened stress reducing region 1520-*a* having a thickness T4-*a* and lower thickened stress reducing region 1520-*b* having a thickness T4-*b*, combined with the height of the thickened stress reducing region 1520 define a geometry that is critical to the improved performance of the striking face portion 1502 of the golf club head. In embodiments, the thicknesses T4-*a* and T4-*b* may both be the same. For example, the thicknesses T4-*a* and T4-*b* may be between about 3.6 mm to about 4.4 mm. In embodiments, the thicknesses T4-*a* and T4-*b* may be between about 3.8 mm to about 4.2 mm. For example, the thicknesses T4-*a* and T4-*b* may be about 4.0 mm. In some embodiments, the thicknesses T4-*a* and T4-*b* could be different from each other without departing from the scope and content of the presently disclosed technology, so long as it does not fall outside the scope of the thickness ranges defined above. In embodiments, the thicknesses T4-*c* and T4-*d* may both be the same. For example, the thicknesses T4-*c* and T4-*d* may be between about 3.6 mm to about 4.4 mm. In embodiments, the thicknesses T4-*c* and T4-*d* may be between about 3.8 mm to about 4.2 mm. For example, the thicknesses T4-*c* and T4-*d* may be about 4.0 mm. In some embodiments, the thicknesses T4-*c* and T4-*d* could be different from each other without departing from the scope and content of the presently disclosed technology, so long as it does not fall outside the scope of the thickness ranges defined above.

Once the thickness T4 and the height H4 of the thickened stress reducing region 1520 have been defined, a preferred geometric shape of the thickened stress reducing region 1520 can be established as a ratio of the thickness and the height. The preferred geometric shape will have a T over H Ratio defined by Equation (1) below:

$$T \text{ over } H \text{ Ratio} = \frac{\text{Thickness } T4 \text{ of Thickened Stress Reducing Region}}{\text{Height } H4 \text{ of Thickened Stress Reducing Region}} \quad \text{Eq. (1)}$$

The T over H Ratio of the thickened stress reducing region 1520 of the striking face portion 1502 may be between about 0.5 to about 1.3. In some embodiments, the T over H ratio may be between about 0.7 to about 1.0. For example, the T over H ration may be about 0.8. Once again, as previously mentioned, this ratio is critical to achieving the stress reducing properties of the striking face portion 1502, all while minimizing the unnecessary mass added by the addition of this thickened stress reducing region 1520.

The thickness of the thinned perimeter region 1522 may be the same for the upper thinned perimeter region 152-*a* and the lower thinned perimeter region 1522-*b*. For example, the thicknesses T5-*a* and T5-*b* may both be less than about 3.0 mm. In some embodiments, the thicknesses T5-*a* and T5-*b* may both be less than about 2.0 mm. In embodiments, the thicknesses T5-*a* and T5-*b* may both be less than about 1.8 mm. In some embodiments, thicknesses T5-*a* and T5-*b* values may be different from one another without departing from the spirit and scope of the presently disclosed technology, so long as both fall within the ranges disclosed above. For example, thickness T5-*a* may be about 1.6 mm and T5-*b* may be about 1.8 mm. In some embodiments, thickness T5-*a* may be thicker than T5-*b*. In embodiments, the thicknesses T5-*c* and T5-*d* may both be the same. For example, the thicknesses T5-*c* and T5-*d* may be between about 0 mm to about 5 mm. In embodiments, the thicknesses T5-*c* and T5-*d* may be between about 0.1 mm to about 3 mm. For example, the thicknesses T5-*c* and T5-*d* may be less than about 2.0 mm. In some embodiments, the thicknesses T5-*c* and T5-*d* could be different from each other without departing from the scope and content of the presently disclosed technology, so long as it does not fall outside the scope of the thickness ranges defined above. For example, there may not be any thickness on thickness T5-*d* because there is no heelward thinned perimeter region 1522.

A relationship between the thickness T4 of the thickened stress reducing region 1520 and the thickness T1 of the thickened central region 1514 is critical to the presently disclosed technology. The introduction of the thickened stress reducing region 1520 greatly decreases the overall thickness and mass of the entire striking face portion 1502, which makes the resultant relationship between the two thicknesses critical to achieving the improved performance of the presently disclosed technology. The ratio of T4 divided by T1 may be greater than about 0.5. In some embodiments, the ratio may be greater than about 0.7. In embodiments, the ratio may be greater than about 1.15. In some embodiments, the ratio may be greater than about 1.4. In some embodiments, the thickness T4 of the thickened stress reducing region 1520 may be greater than a thickness T1 of the thickened central region 1514, or any other location along the entirety of the striking face portion 1502. The thickest portion of the striking face portion 1502 may be located on the thickened stress reducing region 1520. The disclosed ratio is critical to the presently disclosed technology.

The radial distances of the various components may be measured from the geometric face center or from the offset center point. The distances provided here are not constrained in any specific cross-sectional plane A-A' like the previous discussion in FIG. 2, but rather a measurement of the minimum and maximum distances in any radial direction. Radius R5-*a*, radius R5-*b*, radius R5-*c*, and radius R5-*d* may be the radius of curvature or the blend from the thickened stress reducing region 1520-*a*, 1520-*b*, 1520-*c*, and 1520-*d* towards the thinned perimeter region 1522-*a*, 1522-*b*, 1522-*c*, and 1522-*d*. Radii R5-*a*, R5-*b*, R5-*c*, and R5-*d* may be the same value and may be between about 1.0 mm and about 2.5 mm. In some embodiments, radii R5-*a* R5-*b*, R5-*c*, and R5-*d* may be between about 1.5 mm and about 2.0 mm. In embodiments, radii R5-*a* R5-*b*, R5-*c*, and R5-*d* may be between about 1.7 mm and about 1.8 mm. In some embodiments, radii R5-*a* R5-*b*, R5-*c*, and R5-*d* may be different values from one another without departing from the spirit and scope of the presently disclosed technology so long as it falls within the radius ranges disclosed above. In embodiments, radius R5-*a* may have a different radius than radii R5-*c* and/or R5-*d*. For example, in an area nearest to the crown, thickened stress reducing region 1520-*a* may have a radius R5-*a* around 1.7 mm. As thickened stress reducing region 1520-*a*, moves heelward or toeward, the radius may enlarge to about 1.8 mm. In embodiments, radius R5-*b* may have a different radiu than radii R5-*c* and/or R5-*d*. For example, in an area nearest to the sole, radius R5-*b* may be about 1.7 mm. As radius R5-*b* moves heelward or toeward toward radii R3-*c* and/or R3-*d*, the radius may enlarge to about 1.8 mm. In some embodiments, as radii R5-*a* and R5-*b* move heelward or toeward the radius may linearly or non-linearly reduce. In these embodiments, the varying radii may reflect the elliptical shape of thickened stress reducing region 1520 and/or thinned perimeter region 1522.

Radius R3-*a*, radius R3-*b*, radius R3-*c*, and radius R3-*d* may be the radius of curvature or the blend from the thickened stress reducing regions 1520-*a*, 1520-*b*, 1520-*c*, and 1520-*d* towards the thinned intermediate regions 1518-*a*, 1518-*b*, 1518-*c*, and 1518-*d*. Radii R3-*a*, R3-*b*, R3-*c*, and R3-*d* may be the same value and may be between about 1.0 mm and about 3.0 mm. In some embodiments, radii R3-*a* R3-*b*, R3-*c*, and R3-*d* may be between about 1.5 mm and about 2.5 mm. In embodiments, radii R3-*a* R3-*b*, R3-*c*, and R3-*d* may be about 2.0 mm. In some embodiments, radii R3-*a* R3-*b*, R3-*c*, and R3-*d* may be different from one another without departing from the scope and content of the presently disclosed technology so long as it falls within the radius ranges disclosed above. For example, radius R3-*a* may be about 2.2 mm and radius R3-*b* may be about 2.0 mm. In embodiments, radius R3-*a* may have a different radius than radii R3-*c* and/or R3-*d*. For example, in an area nearest to the crown, radius R3-*a* may be about 2.0 mm. As radius R3-*a* moves heelward or toeward toward radii R3-*c* and/or R3-*d*, the radius may linearly or non-linearly enlarge to about 2.2 mm. In embodiments, radius R3-*b* may have a different radius than radii R3-*c* and/or R3-*d*. For example, in an area nearest to the sole, radius R3-*b* may be about 2.0 mm. As radius R3-*b* moves heelward or toeward toward radii R3-*c* and/or R3-*d*, the radius may linearly or non-linearly enlarge to about 2.2 mm. In some embodiments, as radii R3-*a* and R3-*b* move heelward or toeward the radii may linearly or non-linearly reduce. In these embodiments, the varying radii may reflect the elliptical shape of thinned intermediate region 1518 and/or thickened stress reducing region 1520.

It is worth noting here that the radius of the blend from the thickened stress reducing region 220 towards the thinned perimeter region 222 and the thinned intermediate region 218, shown as R5 and R3 respectively, may be the same as one another. In some embodiments, these values may differ from one another without departing from the scope and content of the presently disclosed technology so long as they fall within the ranges above. As discussed herein, it should be appreciated that difference in height and or thicknesses between an upper and lower region may affect the corresponding radii. It should also be appreciated that in some embodiments, thickened stress reducing region 1520 may not be elliptical but a combination of curves, including, for example, splines. In such embodiments, polynomials and/or non-linear curves may define the curvature or blends between thinned intermediate region 1518 and thinned perimeter region 1522.

It should be noted that most of the embodiments discussed here aims to create a releasable hosel hole cover, however, all of these embodiments may include glue to make the hosel hole cover stay within the hosel hole, removing the ability to remove the hosel hoe cover without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion, located at a frontal portion of said golf club head, adapted to impact a golf ball; and a body portion, attached to a rear of said striking face portion, wherein said striking face portion further comprises;

a frontal striking surface, wherein said frontal striking surface is substantially planar, and an internal rear surface, wherein said frontal striking surface and said internal rear surface combine to further comprise;

a thickened central region having a first thickness, a central transition region, extending outward from said thickened central region, having a variable thickness, wherein said central transition region comprises:

a toeward central transition region having a height H2-*c*, a heelward central transition region having a height H2-*d*, a thinned intermediate region, extending outward from said central transition region, having a third thickness, wherein said thinned intermediate region comprises:

a toeward thinned intermediate region having a height H3-*c*, a heelward thinned intermediate region having a height H3-*d*, a thickened stress reducing region, extending outward from said thinned intermediate region, having a fourth thickness, and a thinned perimeter region, extending outward from said thickened stress reducing region, having a fifth thickness, wherein said thickened stress reducing region protrudes rearward from said internal rear surface of said striking face portion, and wherein said height H2-*c* in addition to said height H3-*c* is different than said height H2-*d* in addition to said height H3-*d*, wherein said fourth thickness is greater than said first thickness.

2. The golf club head of claim 1, wherein said fourth thickness of said thickened stress reducing region is a thickest portion of said striking face portion.

3. The golf club head of claim 2, wherein said fifth thickness is greater than said third thickness.

4. The golf club head of claim 1, wherein said thickened stress reducing region has a T over H Ratio of between about 0.5 to about 1.3, said T over H ratio defined as $$T \text{ over } H \text{ Ratio} = \frac{\text{Thickness } T4 \text{ of Thickened Stress Reducing Region}}{\text{Height } H4 \text{ of Thickened Stress Reducing Region}}.$$

5. The golf club head of claim 4, wherein said T over H ratio is between about 0.7 to about 1.0.

6. The golf club head of claim 5, wherein said T over H ratio is about 0.8.

7. The golf club head of claim 4, wherein said thickened stress reducing region further comprises:

an upper thickened stress reducing region, and a lower thickened stress reducing region, wherein said upper thickened stress reducing region and said lower thickened stress reducing region has a same height.

8. The golf club head of claim 4, wherein said thickened stress reducing region further comprises;

an upper thickened stress reducing region, and a lower thickened stress reducing region, wherein said upper thickened stress reducing region and said lower thickened stress reducing region has a different height.

9. The golf club head of claim 8, wherein a height of said upper thickened stress reducing region is smaller than a height of said lower thickened stress reducing region.

10. The golf club head of claim 9, wherein said height of said upper thickened stress reducing region is about 0.5 mm smaller than said height of said lower thickened stress reducing region.

11. The golf club head of claim 1, wherein said height H2-*c* in addition to said height H3-*c* is smaller than said height H2-*d* in addition to said height H3-*d*.

12. The golf club head of claim 1, wherein said height H2-*c* in addition to said height H3-*c* is greater than said height H2-*d* in addition to said height H3-*d*.

13. The golf club head of claim 1, wherein said height H2-*c* is different than said height H2-*c*.

14. A golf club head comprising:

a striking face portion, located at a frontal portion of said golf club head, adapted to impact a golf ball; and a body portion, attached to a rear of said striking face portion, wherein said striking face portion further comprises;

a frontal striking surface, wherein said frontal striking surface is substantially planar, and an internal rear surface, wherein said frontal striking surface and said internal rear surface combine to further comprise;

a thickened central region having a first thickness, a central transition region, extending outward from said thickened central region, having a variable thickness, wherein said central transition region comprises:

a toeward central transition region having a height H2-*c*, a heelward central transition region having a height H2-*d*, a thinned intermediate region, extending outward from said central transition region, having a third thickness, wherein said thinned intermediate region comprises:

a toeward thinned intermediate region having a height H3-*c*, a heelward thinned intermediate region having a height H3-*d*, a thickened stress reducing region, extending outward from said thinned intermediate region, having a fourth thickness, and a thinned perimeter region, extending outward from said thickened stress reducing region, having a fifth thickness, wherein said thickened stress reducing region protrudes rearward from said internal rear surface of said striking face portion, wherein said height H2-*c* in addition to said height H3-*c* is smaller than said height H2-*d* in addition to said height H3-*d* wherein said fifth thickness is less said fourth thickness, and wherein said third thickness of said thinned intermediate region is a thinnest portion of said striking face portion.

15. The golf club head of claim 14, wherein said fourth thickness of said thickened stress reducing region is a thickest portion of said striking face portion.

16. The golf club head of claim 14, wherein said height H2-*c* is smaller than said height H2-*d*.

17. A golf club head comprising:

a striking face portion, located at a frontal portion of said golf club head, adapted to impact a golf ball; and a body portion, attached to a rear of said striking face portion, wherein said striking face portion further comprises;

a frontal striking surface, wherein said frontal striking surface is substantially planar, and an internal rear surface, wherein said frontal striking surface and said internal rear surface combine to further comprise:

a thickened central region having a first thickness, a central transition region, extending outward from said thickened central region, having a variable thickness, wherein said central transition region comprises:

a toeward central transition region having a height H2-*c*, a heelward central transition region having a height H2-*d*, a thinned intermediate region, extending outward from said central transition region, having a third thickness, wherein said thinned intermediate region comprises:

a toeward thinned intermediate region having a height H3-*c*, a heelward thinned intermediate region having a height H3-*d*, a thickened stress reducing region, extending outward from said central transition region and located proximate a perimeter of said striking face portion, wherein said thickened stress reducing region protrudes rearward from said internal rear surface of said striking face portion, and wherein said height H2-*c* in addition to said height H3-*c* is smaller than said height H2-*d* in addition to said height H3-*d*.

18. The golf club head of claim 17, wherein said thickened stress reducing region has a T over H Ratio of between about 0.5 to about 1.3, said T over H ratio defined as $$T \text{ over } H \text{ Ratio} = \frac{\text{Thickness } T4 \text{ of Thickened Stress Reducing Region}}{\text{Height } H4 \text{ of Thickened Stress Reducing Region}}.$$

19. The golf club head of claim 18, wherein said T over H ratio is between about 0.7 to about 1.0.

20. The golf club head of claim 18, wherein said T over H ratio is about 0.8.

* * * * *